US011160403B1

(12) United States Patent
Zalace

(10) Patent No.: US 11,160,403 B1
(45) Date of Patent: Nov. 2, 2021

(54) REUSABLE STRAW ASSEMBLY WITH HOUSING AND CLEANING BRUSH

(71) Applicant: Arix Grant Zalace, Santa Rosa Beach, FL (US)

(72) Inventor: Arix Grant Zalace, Santa Rosa Beach, FL (US)

( * ) Notice: Subject to any disclaimer, the term of this patent is extended or adjusted under 35 U.S.C. 154(b) by 47 days.

(21) Appl. No.: 16/377,223

(22) Filed: Apr. 7, 2019

Related U.S. Application Data

(60) Provisional application No. 62/654,469, filed on Apr. 8, 2018.

(51) Int. Cl.

| | |
|---|---|
| ***A47G 21/18*** | (2006.01) |
| ***A45C 11/24*** | (2006.01) |
| ***A46B 9/02*** | (2006.01) |
| ***B08B 9/04*** | (2006.01) |

(52) U.S. Cl.
CPC ..... *A47G 21/189* (2013.01); *A45C 11/24* (2013.01); *A46B 9/02* (2013.01); *B08B 9/04* (2013.01)

(58) Field of Classification Search
CPC ..... A45C 11/24; A46B 9/02; A47G 21/06; A47G 21/18; A47G 21/189; B08B 9/04
See application file for complete search history.

(56) References Cited

U.S. PATENT DOCUMENTS

| | | | |
|---|---|---|---|
| 942,306 | A | 12/1909 | Clarke |
| 1,114,254 | A | 10/1914 | Greene et al. |
| 1,146,383 | A | 7/1915 | Asquith et al. |
| 1,236,029 | A | 8/1917 | Williams |
| 1,801,171 | A | 4/1931 | Mueller et al. |
| 2,194,011 | A | 3/1940 | Davidson |
| 2,269,593 | A | 1/1942 | Maltby et al. |

(Continued)

FOREIGN PATENT DOCUMENTS

| | | |
|---|---|---|
| CA | 2277261 | 1/2001 |
| CN | 2302722 | 1/1999 |

(Continued)

OTHER PUBLICATIONS

Grainger Choice; 2"X1-½" Pipe Reducer or Increaser, Hub × Hub Fitting Connection Type; Item # 1WJE5; Mfr. Model # 1WJE5; Catalog Page # 2803; UNSPSC # 40142305; https://www.grainger.com/product/GRAINGER-APPROVED-2-x-1-1-2-Pipe-Reducer-or-1WJE5; accessed on Dec. 18, 2018.

(Continued)

*Primary Examiner* — Bryon P Gehman
(74) *Attorney, Agent, or Firm* — Hanrahan Law Firm, P.A.; Benjamin M. Hanrahan

(57) ABSTRACT

A reusable straw assembly is present herein. In particular, the straw assembly includes at least one, although in some cases, a plurality of cylindrical straws having different diameters, a brush assembly including a brush stem terminating with a brush head at a distal end thereof, and a housing comprising a body and at least one end cap. The brush assembly, and in particular, the brush stem is fixed to the end cap. The brush stem is axially disposed relative to the one or more straws, which are then disposed within the housing. In the case where the assembly includes a plurality of reusable straws, the plurality of reusable straws are disposable in a coaxially nested configuration and retained on the brush assembly until manually released by a user.

19 Claims, 35 Drawing Sheets

(56) References Cited

U.S. PATENT DOCUMENTS

| | | | | |
|---|---|---|---|---|
| 2,997,195 | A | 8/1961 | Yuen | |
| 3,168,982 | A | 2/1965 | Davis | |
| 3,189,171 | A | 6/1965 | Miller | |
| 3,288,497 | A | 11/1966 | Nydam | |
| 3,780,944 | A | 12/1973 | Zubalik | |
| 3,971,578 | A | 7/1976 | Schemith | |
| 4,180,346 | A | 12/1979 | Blake | |
| 4,457,542 | A | 7/1984 | Shaefer et al. | |
| 4,688,721 | A | 8/1987 | Inaba | |
| 4,699,318 | A | 10/1987 | Donatello et al. | |
| 4,850,533 | A | 7/1989 | Hoshi et al. | |
| 4,909,437 | A | 3/1990 | Kang | |
| 5,039,012 | A | 8/1991 | Inaba | |
| 5,184,774 | A | 2/1993 | Lipson | |
| 5,361,987 | A | 11/1994 | Matheussen et al. | |
| 5,417,369 | A | 5/1995 | Lipson | |
| 5,513,762 | A | 5/1996 | Janani | |
| 6,039,490 | A * | 3/2000 | Banks | A46B 9/02 15/104.2 |
| 6,585,170 | B2 | 7/2003 | Katsukawa | |
| 6,915,961 | B2 | 7/2005 | Renz et al. | |
| 7,669,781 | B2 | 3/2010 | Sternberger et al. | |
| 8,210,446 | B1 | 7/2012 | Oliviera | |
| 8,231,067 | B1 | 7/2012 | Robinson | |
| 8,342,422 | B2 | 1/2013 | Claessens | |
| 8,540,926 | B2 | 9/2013 | Crawley | |
| 8,579,148 | B2 | 11/2013 | Slansky | |
| 8,584,966 | B2 | 11/2013 | Roche et al. | |
| 8,910,883 | B2 | 12/2014 | Mattheus | |
| 8,915,454 | B2 | 12/2014 | Churchill | |
| 8,978,907 | B2 | 3/2015 | Greenberg | |
| 9,642,484 | B2 * | 5/2017 | Chang | A47G 21/06 |
| 9,820,597 | B1 | 11/2017 | Chang et al. | |
| 10,123,641 | B1 * | 11/2018 | Pepper | A47L 17/00 |
| 2005/0006257 | A1 * | 1/2005 | Tsaur | B65D 77/0406 206/210 |
| 2009/0065605 | A1 | 3/2009 | Roche et al. | |
| 2009/0318900 | A1 | 12/2009 | Tanghoj et al. | |
| 2010/0012668 | A1 | 1/2010 | Hong | |
| 2011/0233297 | A1 | 9/2011 | Roche et al. | |
| 2012/0067909 | A1 | 3/2012 | Mattheus | |
| 2012/0138622 | A1 | 6/2012 | Slansky | |
| 2015/0190004 | A1 | 7/2015 | Chang et al. | |
| 2015/0196150 | A1 | 7/2015 | Chang et al. | |
| 2017/0332814 | A1 | 11/2017 | Chang et al. | |

FOREIGN PATENT DOCUMENTS

| | | |
|---|---|---|
| CN | 202515284 | 11/2012 |
| CN | 108836072 | 11/2018 |
| EP | 0139074 | 5/1985 |
| EP | 0193781 | 9/1986 |
| WO | 2008138351 | 11/2008 |

OTHER PUBLICATIONS

Thunderbird Products; Rubber Coupling Reducer; Rubber Coupling Reducer—SKU: A-RC5; Part Nos. A-56215; A-5632; A-5643; https://thunderbirdproducts.com/rubber-coupling-reducer.html; accessed on Dec. 18, 2018.

Philips Studio Power; Telescopic tube FC6023; https://www.philips.co.uk/c-p/FC6023_01/studiopower-telescopic-tube; Koninklijke Philips N.V., accessed on Dec. 18, 2018.

* cited by examiner

REUSABLE STRAW ASSEMBLY WITH HOUSING AND CLEANING BRUSH

CLAIM OF PRIORITY/CROSS-REFERENCE TO RELATED APPLICATION

The present application is based on and a claim of priority is made under 35 U.S.C. § 119(e) to provisional patent application Ser. No. 62/654,469, filed on Apr. 8, 2018, the content of which is incorporated herein in its entirety by reference.

FIELD OF THE INVENTION

The present invention is generally directed to a reusable straw assembly designed for long term use for both hot and cold drinks. More specifically, the invention relates to a complete self-contained straw set comprising a tubular metal housing with at least one closeable end cap, one or more nesting straws that fit inside the housing, and a brush assembly, for example, a pipe or straw cleaner, that fits inside the straws and housing.

BACKGROUND OF THE INVENTION

Straws have been in use for thousands of years. The first plastic straws were manufactured in the 1960's and their use was popularized by the fast food industry. These straws were used with drinks purchased by people from their vehicles and picked up at a drive through window. Their use allowed for safer consumption of drinks while driving, while also allowing the straws to be thrown away after use. The use and disposal of single-use plastic straws has been a growing problem in the world. In the US, alone, in 2017, it is estimated that more than half a billion disposable straws were used and discarded daily. Many of these straws ended up in the planet's oceans.

Recently there has been a resurgence of interest in paper straws and multi-use, or reusable straws. The paper straws provide a disposable single use alternative to plastic straws, while the multi-use straws provide a longer-term use straw in place of the disposable plastic straw. These multi use straws are made from a variety of materials, and come in many different sizes, colors, and styles.

While both the paper straw and multi-use straw serve as alternatives to harmful disposable plastic straws, they both come with their own set of disadvantages. Single use paper straws require resource intensive production to manufacture. They also lose their structural shape after being submerged in liquids for an extended period of time, especially hot liquids. This is a source of frustration during use and can create the need to use multiple paper straws for the consumption of a single beverage.

The more permanent and structurally sound multi-use straw presents its own set of issues. These straws require cleaning after each use in order to remain sanitary. This is not a problem if they are used at an establishment or home with a means for cleaning and storing them between uses. For individuals that want to be able to take their multi use straws with them on the move, storage and carrying of the straws is a challenge. Multiple carrying cases are available on the market for housing straws and straw sets. These cases are made from various materials including plastics, metals, as well as cloths. The cases are large, cumbersome, and often not sanitary themselves.

One disadvantage of both paper and multi-use straws is the need to use or carry multiple straw sizes for use with different drinks. Smaller diameter straws better serve the need for stirring rods and sipping straws for hot drinks. "Standard" diameter straws are used for most common cold drinks, while larger "jumbo" straws are needed for milkshakes and bubble teas. Trying to find different size diameters in a paper straw presents a problem for consumers, and having to carry all these different sizes in a multi-use set also presents a problem.

Therefore, a need exists in the straw marketplace for a compact, sanitary, easy-to-carry, and easy-to-use straw set capable of providing straws of multiple diameters and lengths for all occasions. A further need exists for a straw set that not only provides all the size straws needed for various applications, but also a single sanitizing apparatus capable of cleaning all of these varying sized straws. Finally, there is also a need for a compact straw set that is not only self-contained but also uses an innovative design to reduce the overall size of the set, allowing for easier handling and carrying while providing sanitary housing of all aforementioned straws and cleaning components.

SUMMARY OF THE INVENTION

The present invention is generally directed to a straw assembly which includes at least one, and in some cases, a plurality of reusable straws, a brush assembly, and an external carrying case or housing capable of sealing the straw(s) and brush assembly in a sanitary, air tight, and compact self-contained enclosure.

In at least one embodiment, the reusable straw(s) will all fit within each other in a coaxially nested configuration, wherein the brush assembly, and in particular the brush head will extend longitudinally and laterally beyond each of the straw(s). In this manner, the straw(s) will be retained between the brush head and the cap in the coaxial nested configuration until a manual sliding force is exerted thereupon, thereby releasing the straw(s).

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
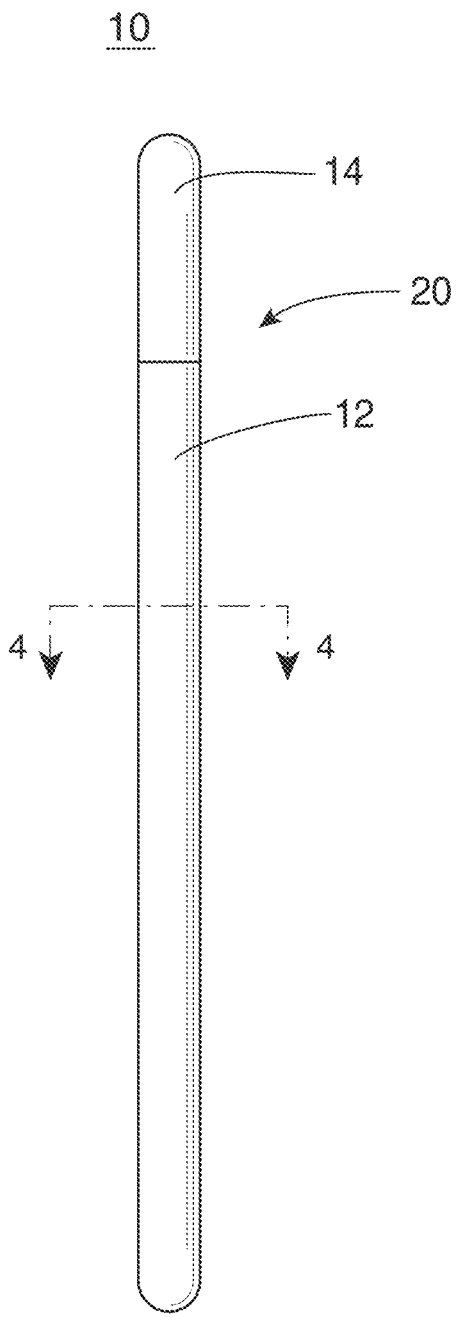
FIG. 1 is a side view of the straw assembly as disclosed in accordance with at least one embodiment of the present invention.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises," "comprised," and/or "comprising," when used in this specification, specify the presence of stated features, steps, operations, elements, and/or components, but do not preclude the presence of addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New straws, straw cleaners, straw housings, and methods for sanitizing and keeping the sanitary nature of these straws are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Referring to the figures, wherein like numerals indicate like or corresponding parts or components throughout the many views, various embodiments are detailed presenting numerous styles or variations of the preferred embodiment.

As shown in the accompanying drawings, and with particular reference to FIGS. 1 through 5, for example, the present invention is generally directed to a reusable straw assembly, referenced as 10. In particular, the reusable straw assembly 10 of at least one embodiment of the present invention includes a housing 20, within which one or a plurality of reusable straws 30, 40, 50 can be stored or otherwise disposed. For instance, as described herein, the straws 30, 40, 50 may be coaxially disposed in a nested configuration, and placed or stored within the housing 20. Specifically, when not in use, the straws 30, 40, 50 can be stored within the housing 20, which can, in turn, be easily carried, for example, in a pocket, purse or bag, or stored in a drawer or other location. When the user wishes to use one or more of the straws 30, 40, 50, the one or more straws 30, 40, 50 can be easily removed from the housing 20, as described herein.

Sill referring to FIGS. 1 through 5, the housing 20 of at least one embodiment may include a cylindrical or substantially cylindrical tube structure with a hollow or open interior portion 25. It should be noted, however, that other shapes or configurations, instead of a substantially cylindrical housing, such as, for example, one having a rectangular, square, pentagon, hexagon, or octagon cross-section is contemplated within the full spirit and scope of the present invention.

Furthermore, the housing 20 may, in at least one embodiment, be made of metal, aluminum, stainless steel, plastic, glass, Pyrex, or other durable food grade material. Similarly, the various straws 30, 40, 50 disclosed herein may be made of metal, aluminum, stainless steel, plastic, glass, Pyrex, or other durable food grade material.

In the embodiment shown in FIGS. 1 through 5, the housing 20 may be a similar shape as each of the one or more straws 30, 40, 50, although with a larger diameter than the straws 30, 40, 50. This allows the straws 30, 40, 50 to be coaxially nested within the housing 20 as shown.

Figure 5:
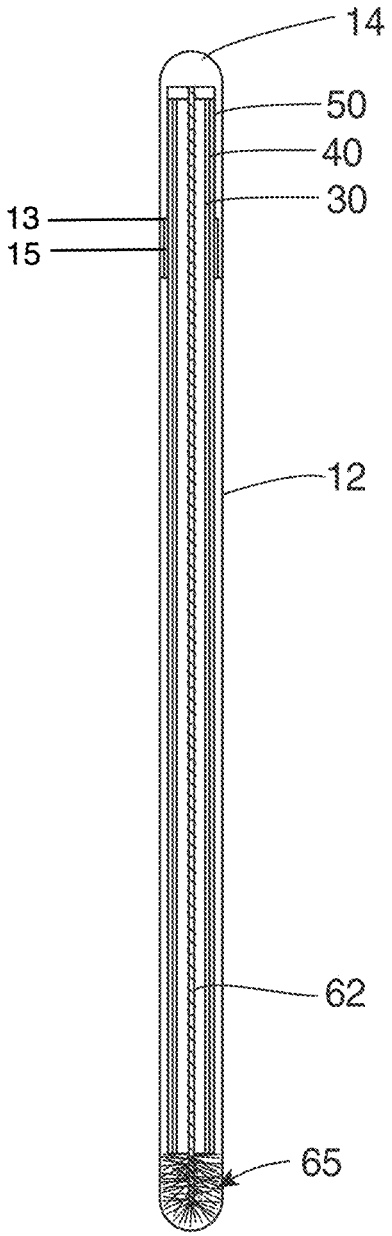
FIG. 5 is a side cut-away view of the straw assembly as disclosed in accordance with at least one embodiment, wherein the plurality of straws are disposed in a coaxially nested configuration around the brush assembly and within the housing.

Moreover, the housing 20 of at least one embodiment includes a housing body 12 and at least one end cap 14. The housing body 12 of at least one embodiment includes an elongated configuration within which a substantial portion or most of the longitudinal length of the straws 30, 40, 50 are disposed when stored therein. As shown in FIG. 5, for example, the one or more straws 30, 40, 50 may extend into a hollow interior portion of the cap 14 when the straws 30, 40, 50 are stored within the housing. In other embodiments, the housing body 12 may include a length that is long enough to receive the entire length of the straws 30, 40, 50 therein.

Figure 3A:
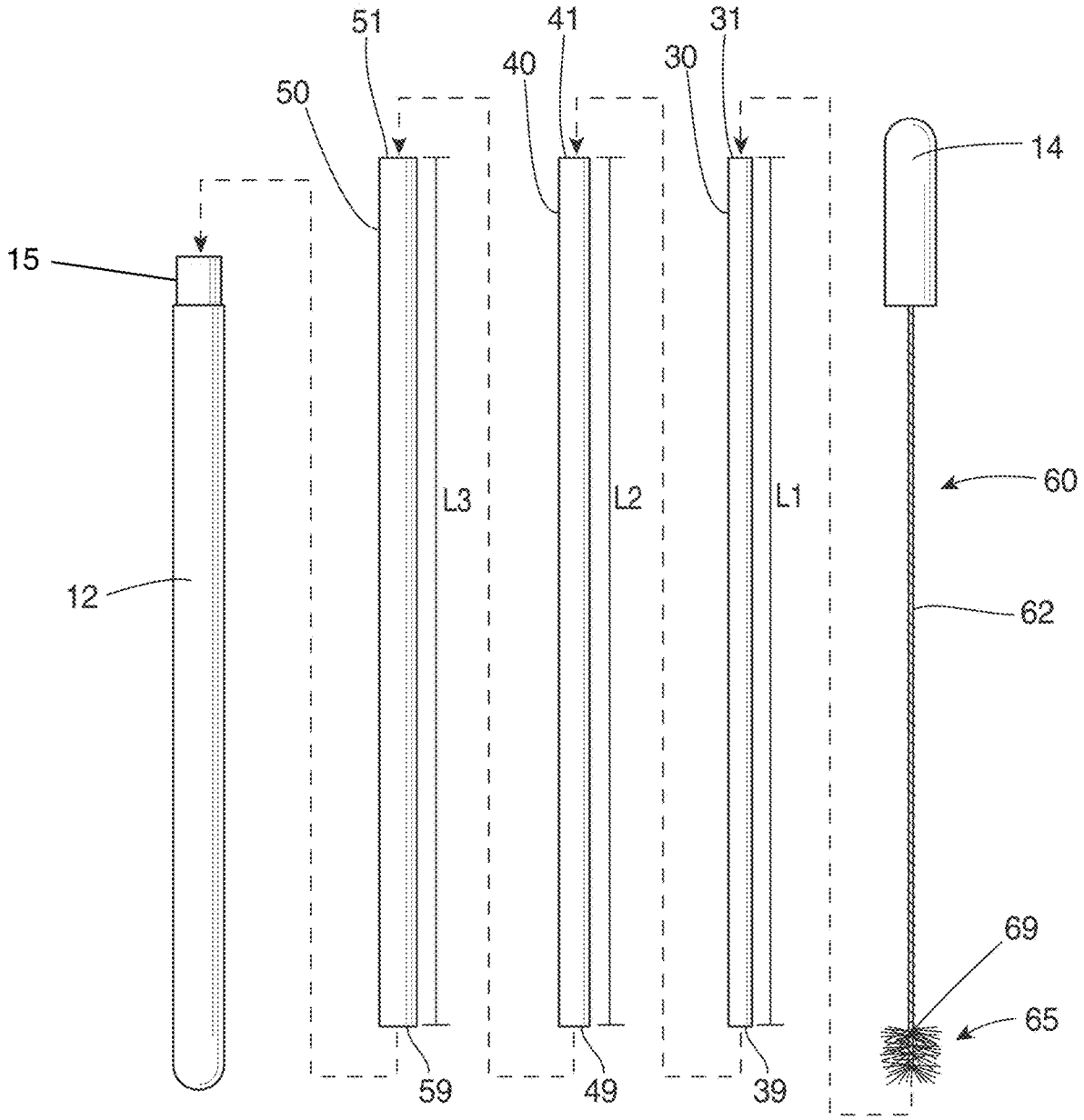
FIG. 3A is an exploded view of the straw assembly as disclosed in accordance with at least one embodiment of the present invention.
Figure 3B:
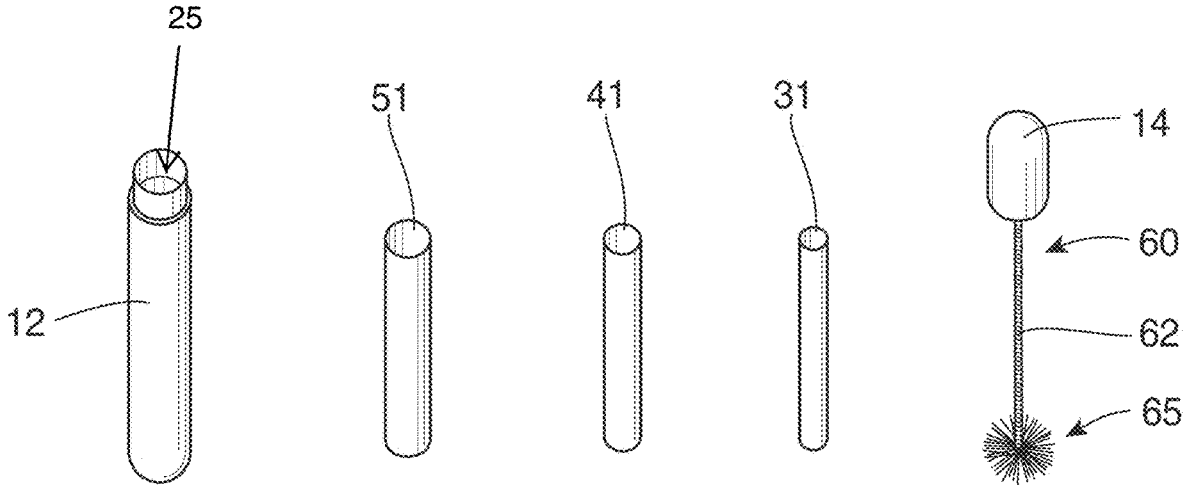
FIG. 3B is a top perspective view of the straw assembly illustrated in FIG. 3A.
Figure 4:
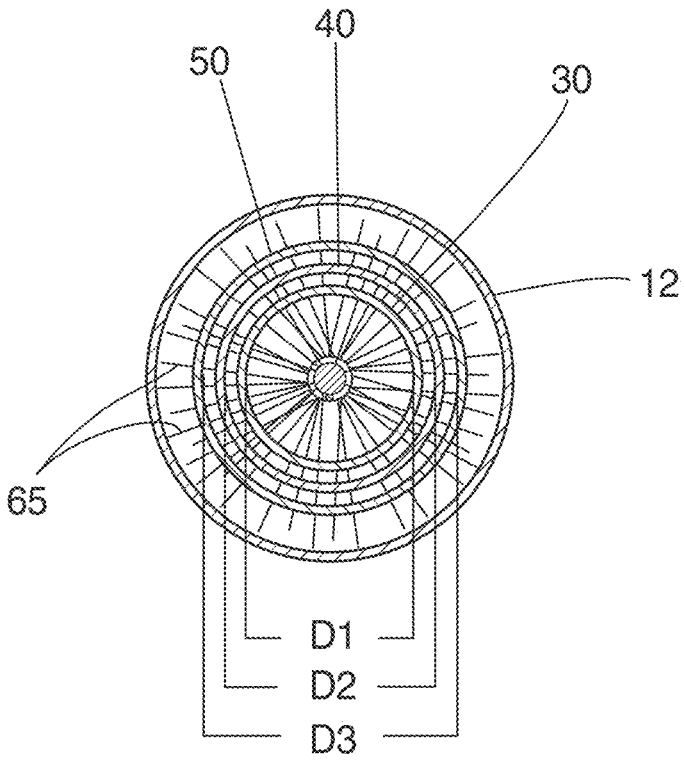
FIG. 4 is a top-down cut away view along line 4-4 of FIG. 1 illustrating a plurality of reusable straws disposed in a coaxially nested configuration in accordance with at least one embodiment of the present invention.

In any event, with reference to FIGS. 3A, 3B and 4, the straw assembly 10 of at least one embodiment includes a plurality of reusable straws 30, 40, 50 each of which includes a tubular configuration with a first end 31, 41, 51, a second end 39, 49, 59, a length L1, L2, L3 and a longitudinally open interior portion extending between the first end and second end and entirely through the length of the straw 30, 40, 50. In some embodiments, such as that shown in FIG. 3A, for example, each of the reusable straws 30, 40, 50 may have the same or similar lengths L1, L2, L3. However, it is contemplated that other embodiments may include a plurality of straws having different or varying lengths.

With reference to FIG. 4, the longitudinally open interior portion of each of the reusable straws 30, 40, 50 includes a diameter D1, D2, D3. In the embodiments shown, each straw 30, 40, 50 includes a longitudinal open interior that is uniform throughout. In other words, the diameter D1 of straw 30 is the same along the entire length L1 of the straw 30.

Furthermore, in the various embodiments disclosed herein with a plurality of straws 30, 40, 50, the diameters D1, D2, D3 are all different from one another, for instance, in ascending order from small straw 30, to medium straw 40, and to large straw 50, thereby allowing the straws 30, 40, 50 to be coaxially nested relative to one another. As an example, diameter D1 of reusable straw 30 may be smaller than diameter D2 of reusable straw 40, and diameter D2 of reusable straw 40 may be smaller than diameter D3 of reusable straw 50. In this manner, the straw assembly 10 includes multiple straws of different diameters or sizes that can be nested and stored within the housing 20. As just an example, straw 30 may be suitable as a small stir stick or straw for use with coffee or tea, straw 40 may be suitable for most beverages such as soda or water, and straw 50 may be suitable for milk shakes or other like substances with a thick consistency.

In addition, the straw assembly 10 of at least one embodiment includes a brush assembly 60. The brush assembly 60 includes a brush stem 62 and a brush head 65. The brush stem 62 may be fixed or otherwise connected to the cap 14 of the housing 20 and extending longitudinally therefrom, terminating at the brush head 65 disposed on a distal end 69 thereof. In at least one embodiment, the brush stem 62 is seated within a hole disposed on the cap 14, and securely affixed therein, for example, via adhesive, melding, or other manner.

The brush head 65 of at least one embodiment includes a plurality of bristles or other like fibers that are affixed to the brush stem 62 and extend outward therefrom. When the bristles engage or contact the inner surface of the straws and/or the inner surface of the housing body, the bristles will clean or remove extraneous moisture, dirt, particles, food, or beverage remnants or residue therefrom. The bristles can be made of plastic, nylon, cotton, polyester, wire, metal, or other materials capable of facilitating practice of the present invention in the intended manner. It should also be noted that the brush head 65 of certain embodiments may not include a plurality of bristles and may instead include a more uniform or continuous cloth-like surface, as just an example.

Figure 2:
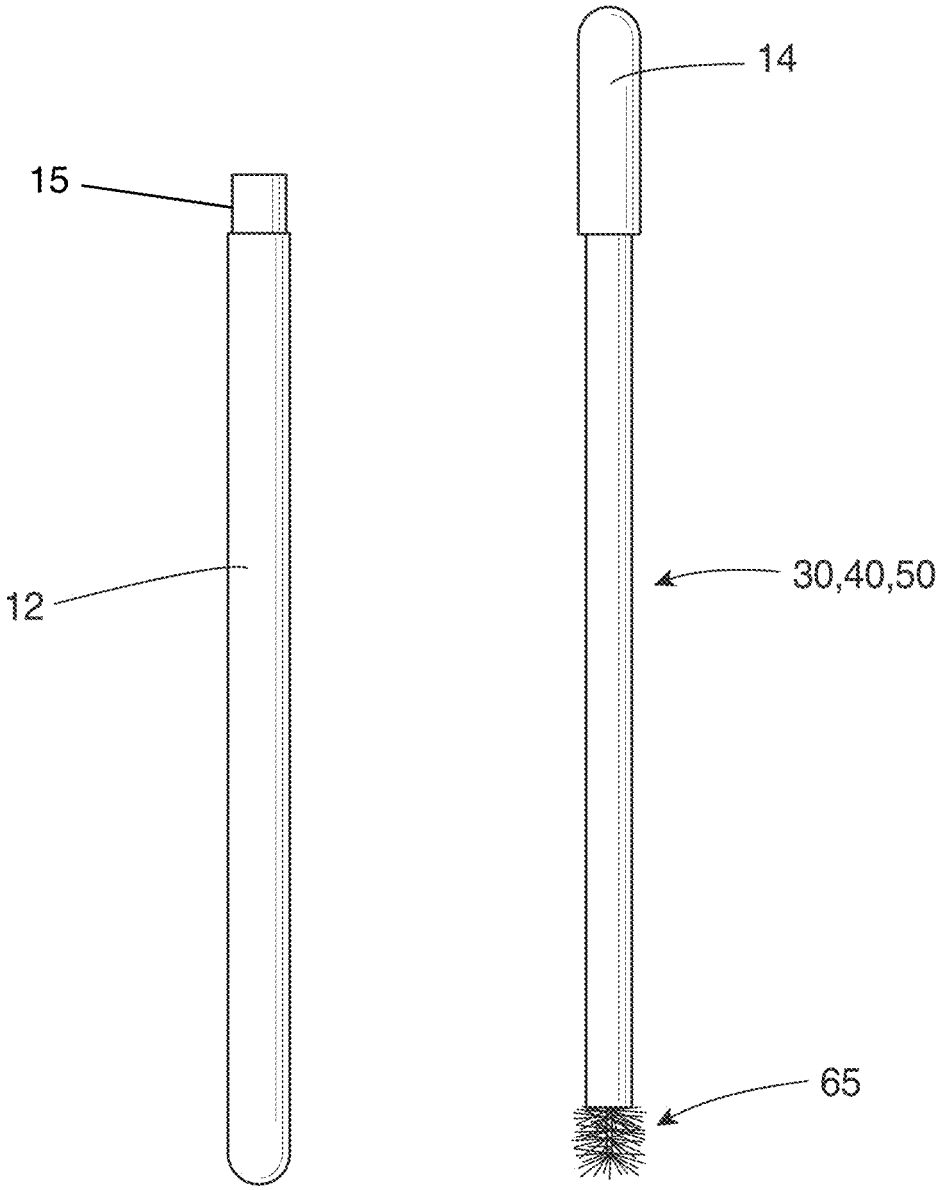
FIG. 2 is a side view illustrating the housing body separated from the end cap, nested straws and brush assembly, wherein the brush head retains the plurality of straws in the nested configuration around the brush stem.

As shown in FIGS. 2 and 5, for example, the brush stem 62 and brush head 65 are disposed within the straws 30, 40, 50. In particular, brush stem 62 may be axially disposed through the first end 31 of the straw 30 with the smallest diameter, and along the longitudinal interior thereof until the brush head 65 extends longitudinally beyond all of the straws (FIG. 2). In this manner, the entire length L1, L2, L3 of each of the straws 30, 40, 50 will fit on the brush stem 62, with the entire brush head 65 extending through the second ends 39, 49, 59 thereof. In this manner, the brush assembly, including the brush stem 62 and the brush head 65, includes a length that is greater than a length L1, L2, L3 of each of the straws 30, 40, 50, thereby allowing the brush head to extend longitudinally beyond the second ends of the straws while the brush stem 62 is axially disposed within the nested straws 30, 40, 50.

Furthermore, in at least one embodiment, the brush head 65 will also extend laterally beyond the second ends 39, 49, 59 of the straws 30, 40, 50. For instance, the brush head 65 includes a normal or relaxed width that is greater than the diameters D1, D2, D3 of the straws 30, 40, 50. More specifically, when pushed through the straws, the brush head 65 will laterally compress inward allowing the brush head to engage or otherwise contact the inner surface of the corresponding straw. When the brush head 65 is pushed all the way through the straws so that the brush head 65 extends longitudinally beyond the second end of the straws, (for example, as shown in FIG. 2), the brush head 65, and in particular, the plurality of bristles that make up the brush head, will expand outward and return to a normal or relaxed width, which extends laterally beyond the second ends 39, 49, 59 of the straws 30, 40, 50.

In this manner, the brush head 65 will contact or engage the inside surface of whichever straw 30, 40, 50 it is pushed through, thereby cleaning the inside surface with each pass. In addition, with the brush head 65 pushed completely or substantially through the straws 30, 40, 50, the brush head 65 can function to at least partially retain the straws 30, 40, 50 between the brush head 65 and the cap 14. This can be advantageous, for example, when removing the cap 14, and nested straws 30, 40, 50 from the housing body 12. Specifically, with the nested straws 30, 40, 50 retained between the cap 14 and the brush head 65, the straws 30, 40, 50 will not fall or otherwise be removed from the nested orientation unless and until a manually sliding force is exerted thereupon.

More in particular, a user can simply remove the cap 14 from the housing body 12, and the straws 30, 40, 50 will remain nested and retained between the brush head 65 and the cap 14. This allows the user to selectively and manually slide the straws 30, 40, 50, one by one, or collectively, from the brush assembly 60. For example, starting with the outer straw or the straw 50 with the largest diameter D3, the user can slide the straw 50 off of the brush assembly 60, thereby passing the brush head 65 longitudinally through the straw 50 from the second end 59 to and through the first end 51. This will, of course, clean the inside surface of the straw 50 as the brush head 65 or the bristles of at least one embodiment contact or engage the inside surface of the straw 50.

Next, the user can remove the next straw, for example, medium straw 40, by sliding the straw 40 off of the brush assembly 60, thereby passing the brush head 65 longitudinally through the straw 40. Again, this will clean the inside surface of straw 40 as the brush head 65 or the bristles of at least one embodiment contact or engage the inside surface of the straw 40.

Finally, the user can remove the next straw, for example, the small straw 30, by sliding the straw 30 off of the brush assembly 60, thereby passing the brush head 65 longitudinally through the straw 30. As before, this will clean the inside surface of straw 30 as the brush head 65 or the bristles of at least one embodiment contact or engage the inside surface of the straw 30.

In this regard, the straws 30, 40, 50 are at least partially retained on the brush stem 62 in a nested relation with one another, until manually removed therefrom. In other words, the brush head 65 includes a rigidity, stiffness, resiliency and width capable of or otherwise structured to prevent or restrict the reusable straws 30, 40, 50 from sliding off of the brush stem 62, absent application of a manual sliding force to the straws. As just an example, the brush head 65 may include a plurality of bristles constructed of nylon with a diameter of 0.2 millimeters or greater. In this manner, with the brush assembly axially disposed through the straw(s), and with the brush head 65 and/or bristles extending laterally and longitudinally beyond the second ends of the straws, the bristles restrict or prevent the straws from sliding off of the brush stem 62, absent a manual or other additional force applied thereto. More in particular, gravity, alone, is not sufficient to cause the straws 30, 40, 50 to slide off of the brush assembly 60. Rather, a manual sliding force, such as a user grabbing the straw(s) 30, 40, 50 and forcing the straw(s) 30, 40, 50 past the brush head 65 will allow the straw(s) 30, 40, 50 to be removed therefrom. It is also worth noting that a manual sliding force could also include a user forcibly swinging or flinging the straw(s) such that an inertial or other like force can cause the straw(s) to bypass the brush head 65.

In other words, the resiliency and rigidity of the brush head 65 creates a resistance against the inside of the straws as the straws are removed one by one.

Moreover, the brush assembly 60 of at least one embodiment may comprise a brush stem 62 constructed from a food grade material such as stainless steel or plastic, although other materials are contemplated and with the scope of the present invention. In some embodiments, the brush stem 62 includes a rigid food grade wire folded in half, with the two resulting parallel legs of the wire being twisted to form a more rigid single leg. The brush head 65 may be constructed of a food grade material such as plastic, although other materials are contemplated within the scope of the present invention. A protective coating may be added to at least a portion of the brush stem 62 or assembly 60 to prevent corrosion or scratching.

Furthermore, with reference to the cut-away view of FIG. 5, the brush head 65 of at least one embodiment includes a width equal to or slightly larger than the internal diameter of the housing 20. This allows the brush head 65 of at least one embodiment to contact or slide against the internal surface of the housing body 12, for example, as the brush assembly 60, and in some cases, the reusable straws 30, 40, 50 are disposed therein. Thus, when the cap 14 of at least one embodiment is secured to the body 12, and when the cap 14 is removed from the body 12, the brush head 65 will slide along the internal surface of the housing 20, and therefore, clean the surface thereof.

Additionally, still referring to the embodiment of FIGS. 1 through 5, the body 12 of the housing 20 may include a neck portion 15 at or near the opening with a reduced outer diameter. In this manner, the cap 14 may include a shoulder 13 which is structured to abut the top edge of the neck 15. This allows the outer diameter of the cap 14 to match the outer diameter of the body 12 such that when the cap 14 is connected to the body 12, the outer surfaces thereof match or align with one another. The cap 14 illustrated in FIGS. 1 through 5, includes a push/pull cap that frictionally engages the body 12. Other embodiments may include different cap and body configurations, including, but not limited to a screw cap, e.g., with corresponding threaded components disposed on the cap and body.

Figure 6:
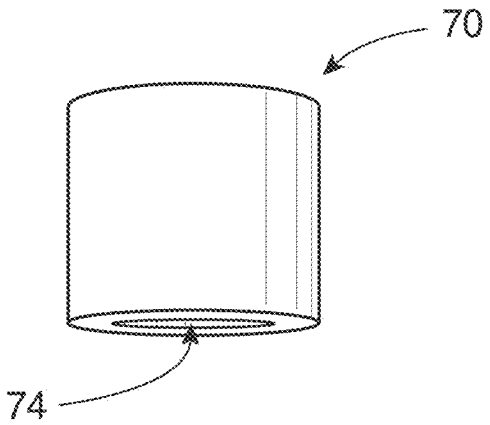
FIG. 6 is a partial perspective view of the attachment member as disclosed in accordance with at least one embodiment of the present invention.
Figure 7:
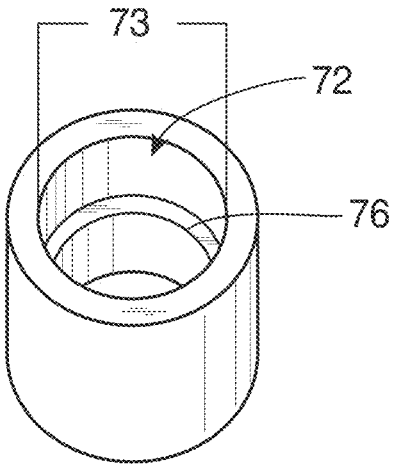
FIG. 7 is another perspective view of the attachment member illustrated in FIG. 6.
Figure 8:
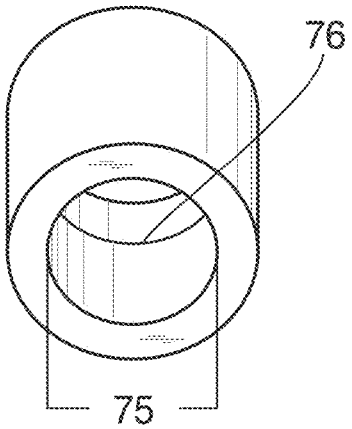
FIG. 8 is another perspective view of the attachment member illustrated in FIGS. 6 and 7.

Turning now to FIGS. 6, 7 and 8, at least one embodiment of the present invention also includes an attachment member, generally referenced as 70. The attachment member 70 of at least one embodiment includes a tubular construction with opposing open ends, such as a first open end 72 and a second open end 74. An open channel is defined through the attachment member 70 between the first and second opposing open ends 72, 74. The attachment member 70 can be constructed of a rubber or plastic material, although other food grade materials are contemplated.

Figure 9A:
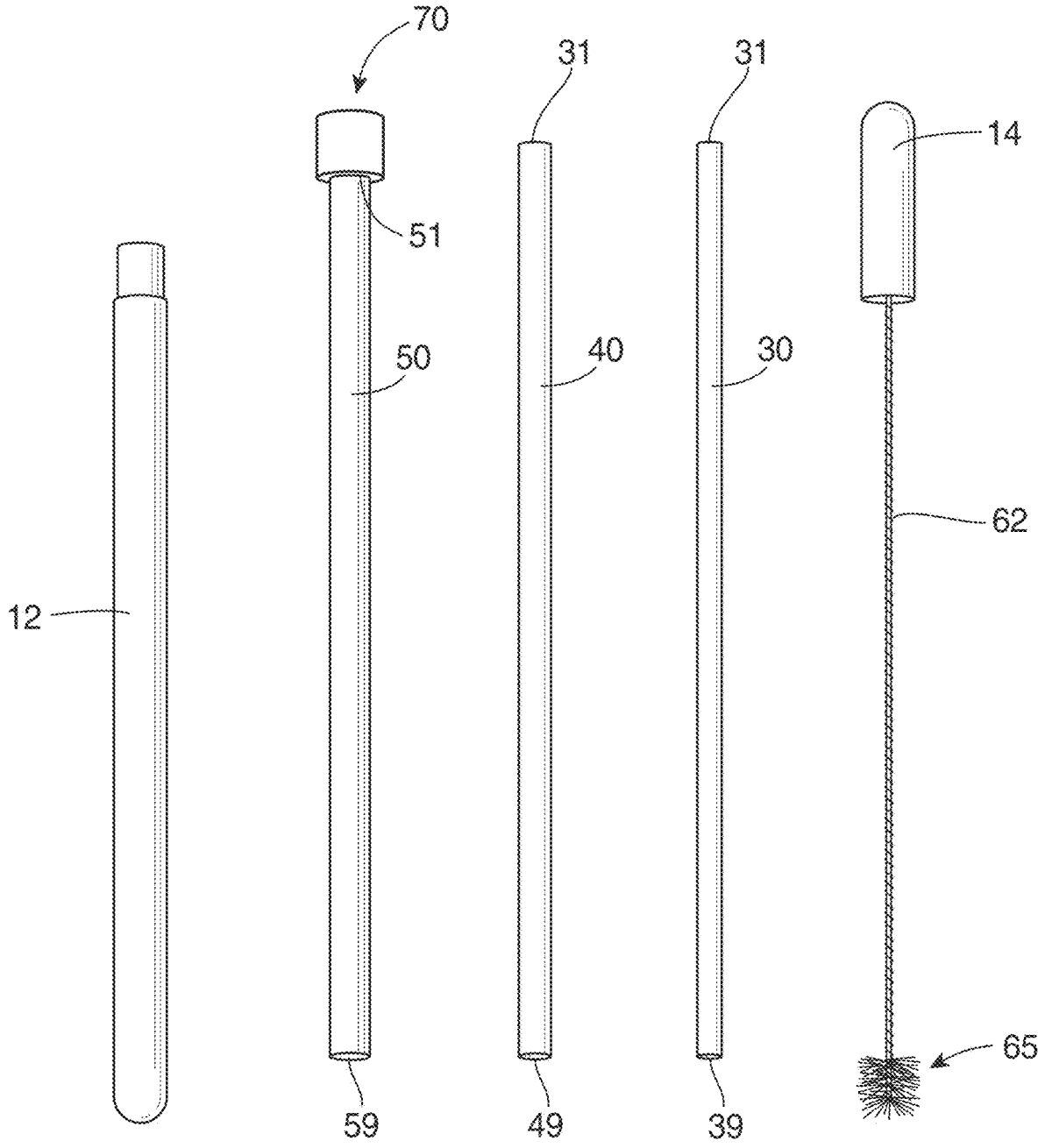
FIG. 9A is a side exploded view with the attachment member attached to one end of one straw, as disclosed herein.
Figure 9B:
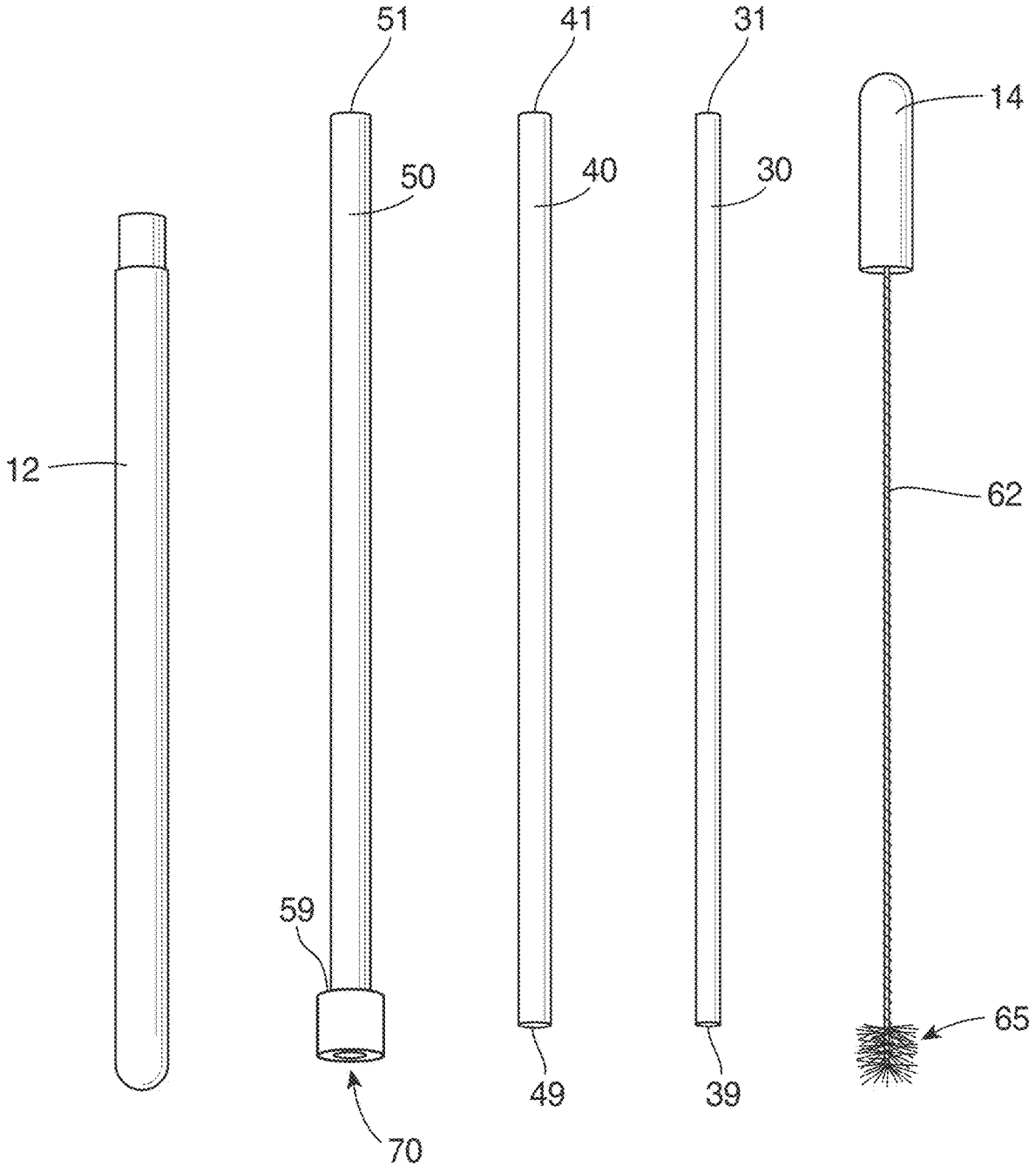
FIG. 9B is a side exploded view with the attachment member attached to another end of one straw, as disclosed herein.
Figure 9C:
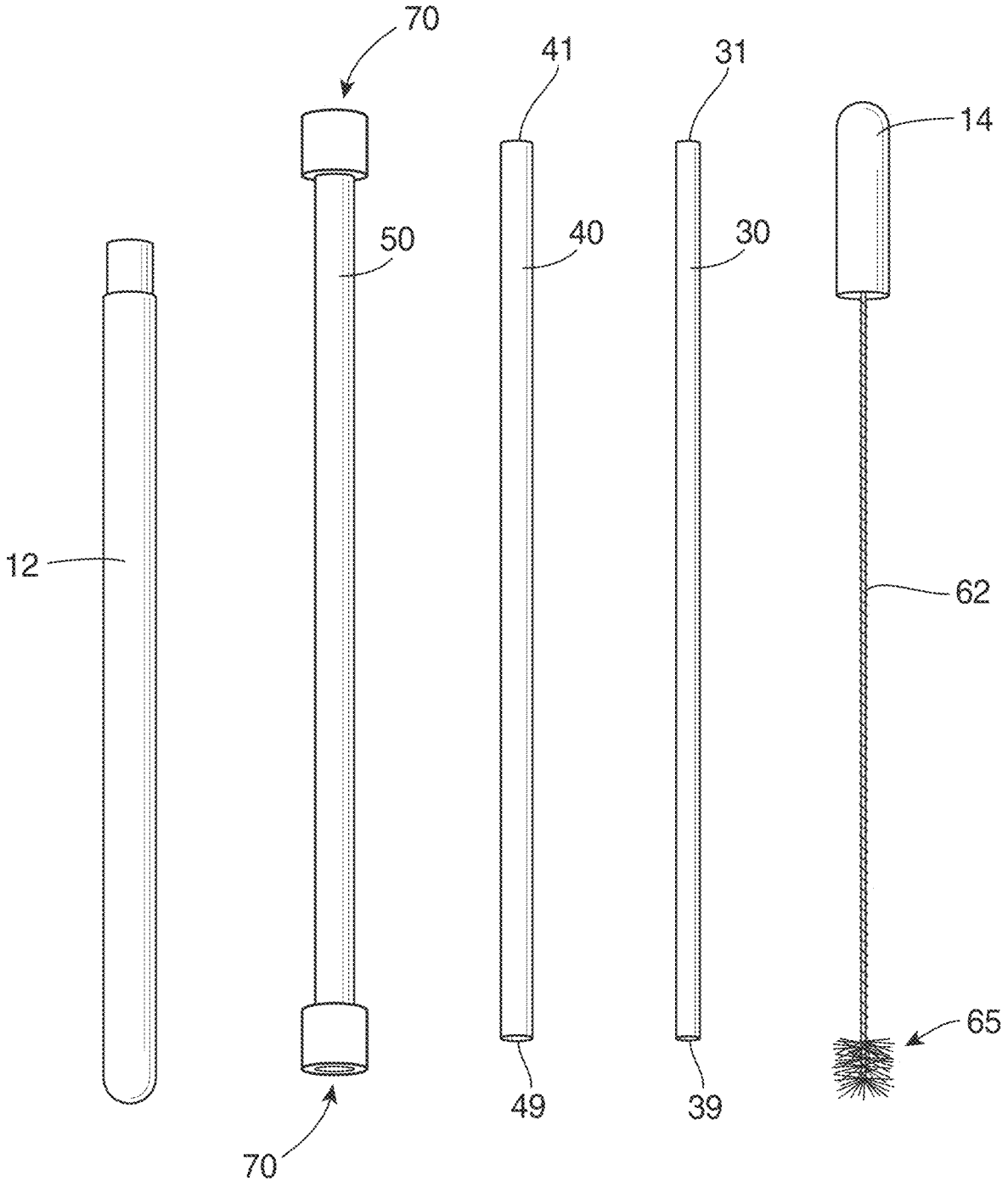
FIG. 9C is a side exploded view with two attachment members, one attached to a different end of a common straw.

With reference to FIGS. 9A, 9B, and 9C, for example, the straw assembly 10 may include an attachment member 70 removably disposed on one or both ends of any one or more of the straws 30, 40, 50. For instance, in FIG. 9A, an attachment member 70 is disposed on one end, e.g., first end 51, of one of the straws 50. Accordingly, at least one of the open ends 73 of the attachment member 70 includes a diameter substantially the same or slightly larger than the outer diameter of one of the straws 50. Disposition of the attachment member 70 to the end 51, 59 of the straw 50 is thus accomplished by frictional engagement and pushing the attachment member 70 on and pulling the attachment member 70 off.

The attachment member(s) 70 will generally be added or connected to a straw 30, 40, 50 after the straw 30, 40, 50 is removed from the housing 20, and then removed from the straw 30, 40, 50 before placing the straw back in the housing 20. It is contemplated, however, that in some embodiments, the attachment member(s) 70 may remain connected or attached to the straw(s) 30, 40, 50 while the straws 30, 40, 50 are stored within the housing 20.

In any event, in the illustration of FIG. 9A, the user will drink from end 51 of the straw 50 such that his/her mouth may engage on or around attachment member 70, instead of the straw 50 directly. For instance, in the embodiment where the straw 50 is constructed of metal or plastic, a user may find it more comfortable and more enjoyable to engage or touch his/her mouth to the attachment member 70, which may be constructed of a soft, resilient rubber material. This also allows multiple people to use different or their own attachment members 70 with the same straw 50.

FIG. 9B illustrates the attachment member 70 attached to the second end 59 of straw 50. For illustrative purposes, second end 59 of the straw 50 will be disposed into the beverage. For example, in the embodiment where the straw is constructed of metal or plastic, a user may find that the second end 59 of the straw 50 that contacts the beverage container, which may be constructed of glass, metal, or other like substance, may create a loud or unpleasant sound. In this manner, the user may find it more enjoyable to attach attachment member 70 to the second end 59 of the straw 50 such that the softer material, e.g., rubber, of the attachment member 70 contacts the beverage container and reduces or minimizes potentially unpleasant sounds.

FIG. 9C is provided for purposes of illustrating that the straw 50 may include an attachment member removably attached to both ends 51, 59 of the straw.

Figure 10A:
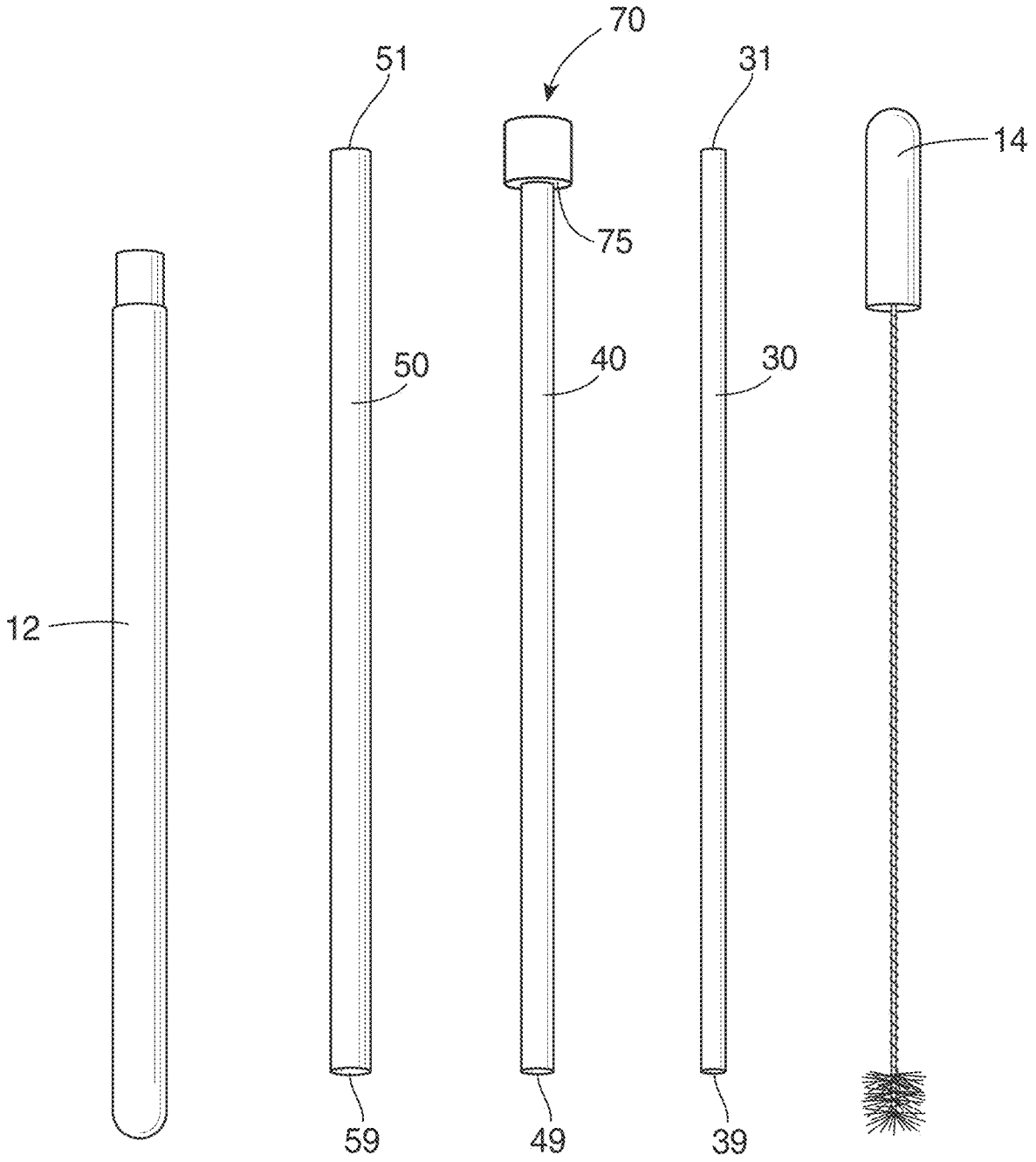
FIG. 10A is a side exploded view with the attachment member attached to one end of another straw, as disclosed herein.
Figure 10B:
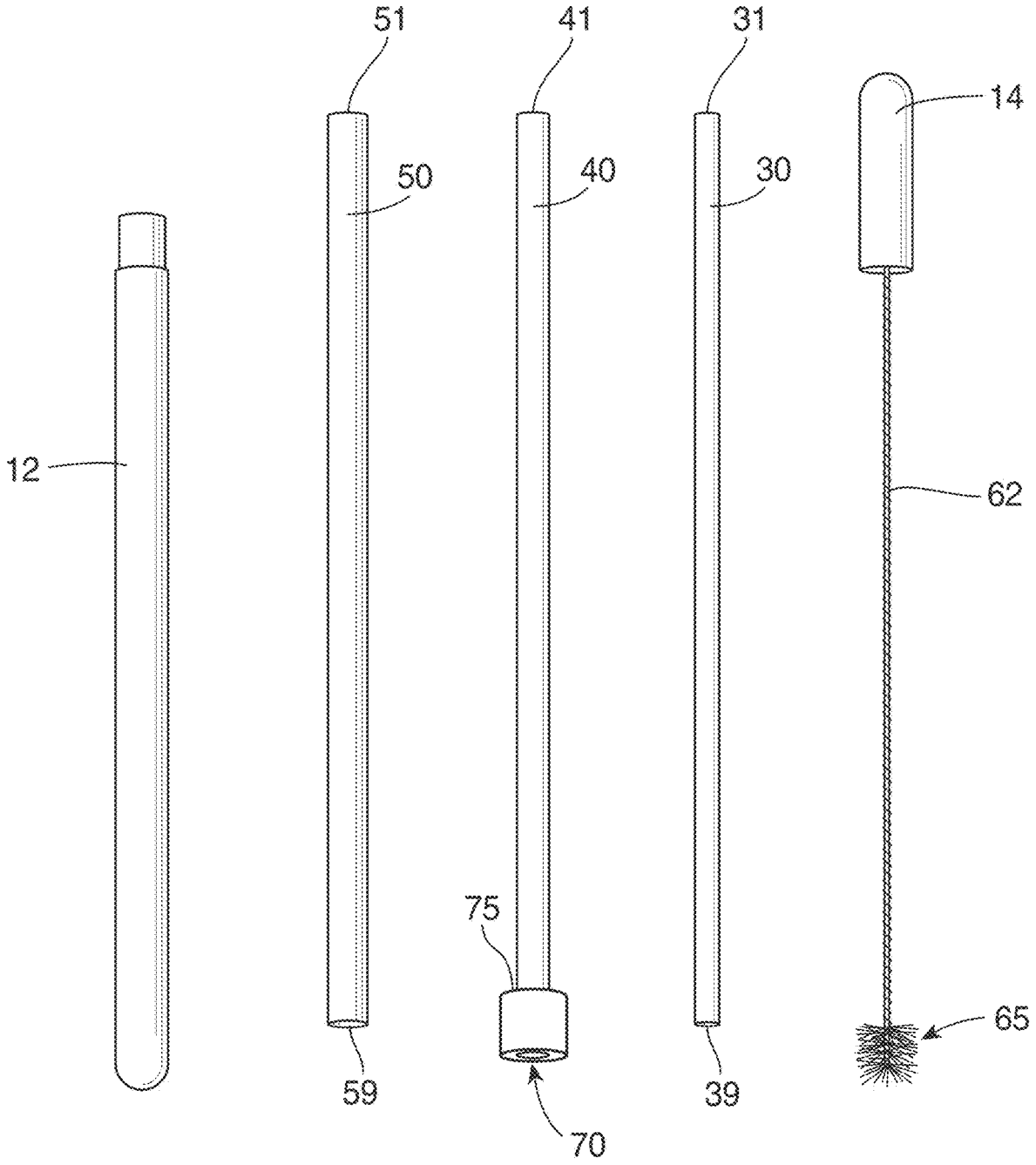
FIG. 10B is a side exploded view with the attachment member attached to another end of one straw, as disclosed herein.
Figure 10C:
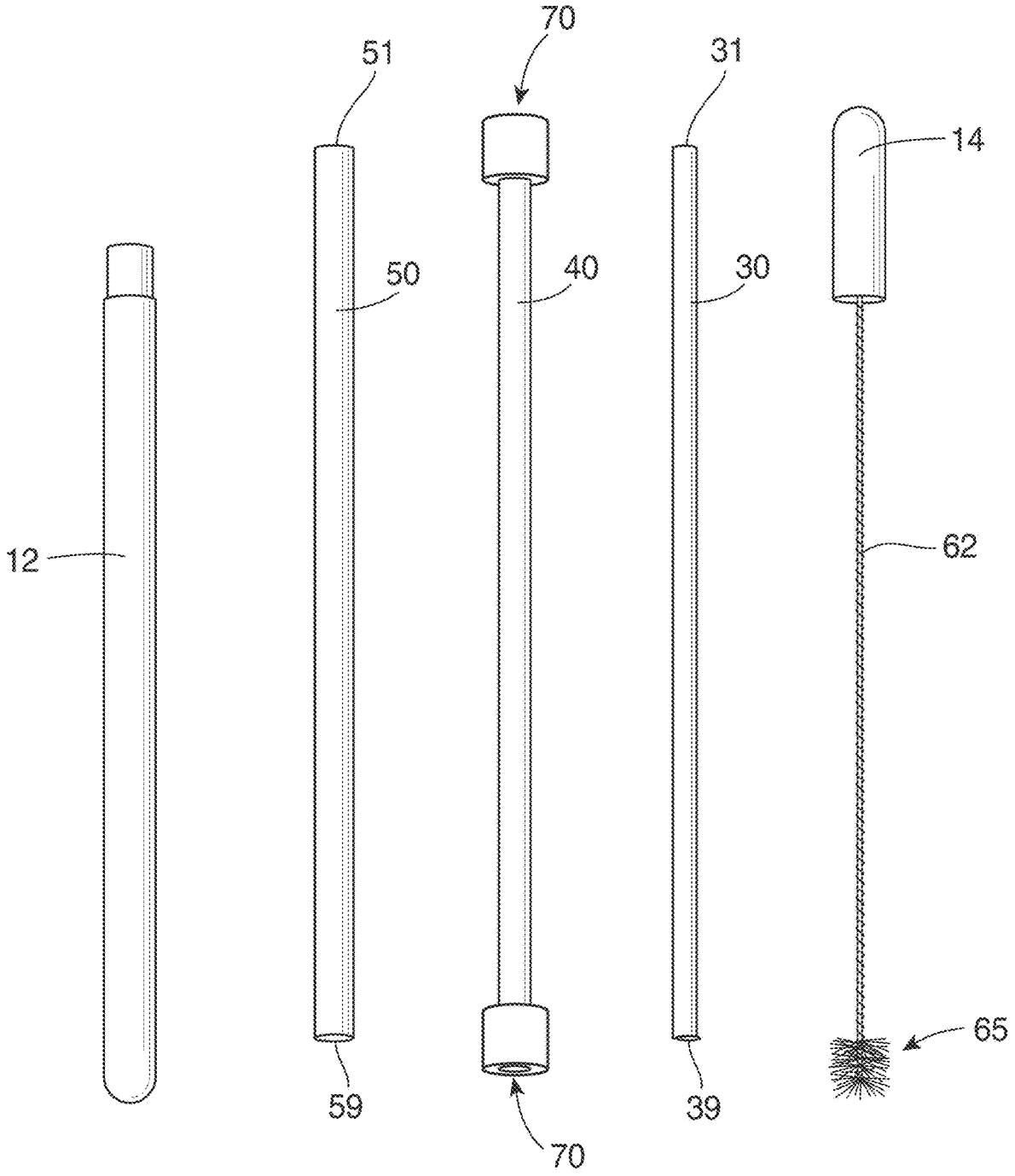
FIG. 10C is a side exploded view with two attachment members, one attached to a different end of a common straw.

FIGS. 10A through 10C are provided to illustrate that the attachment member 70 may be attached to other straws of the straw assembly 10, for example, straw 40. For instance, with reference again to FIGS. 6, 7 and 8, the attachment member 70 of at least one embodiment may include opposing ends 72, 74 with different diameters 73, 75, respectively. In particular, diameter 73 may be sized to frictionally fit over the ends 51, 59 of one straw, while diameter 75 may be sized to frictionally fit over the ends 41, 49 of a different sized straw 40. In this example, diameter 73 of open end 72 is larger than diameter 75 of opposing open end 74. Thus, open end 72 may be sized to frictionally engage ends 51, 59 of one straw, whereas open end 74 may be sized to frictionally engage ends 41, 49 of a smaller straw 40. This allows a single attachment member 70 to be used in connection with multiple straws of different diameters.

Figure 11:
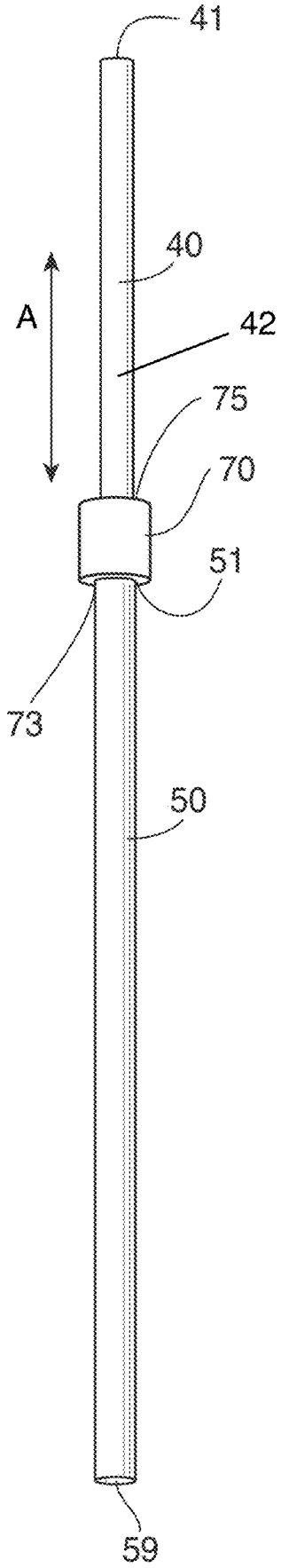
FIG. 11 is a side and partial perspective view of a telescoping straw, as disclosed in accordance with at least one embodiment of the present invention.
Figure 12:
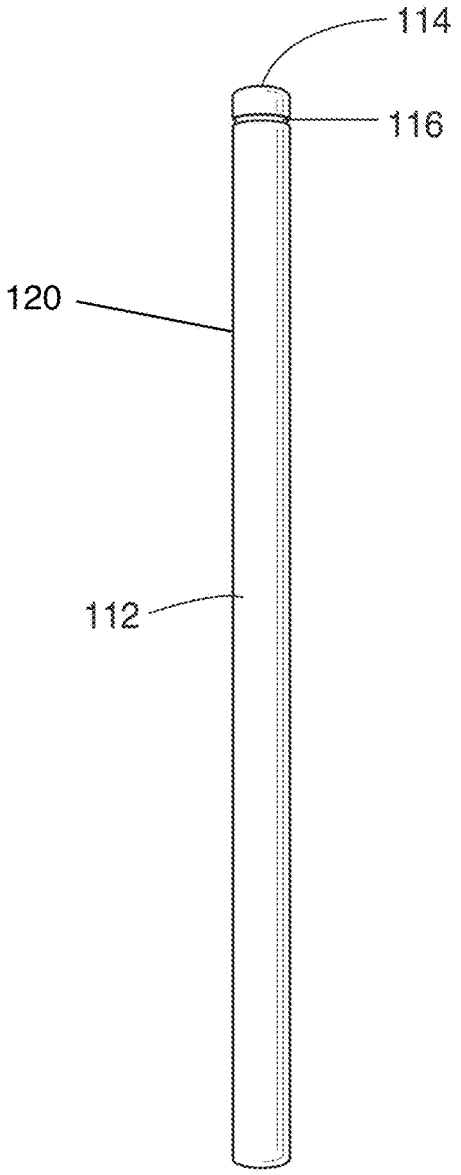
FIG. 12 is a side view of yet another embodiment of the straw assembly as disclosed herein.

With reference now to FIG. 11, the attachment member 70 may also or instead be used to telescopically dispose one straw (e.g., straw 40) relative to another straw (e.g., straw 50). To do so, one open end, e.g., end 72, of attachment member 70 may be frictionally or otherwise connected to one end, e.g., end 51, of one straw, e.g., straw 50. Another straw having a smaller diameter, e.g., straw 40, may then be disposed through the opposing opening 74 of the attachment member 70. The attachment member 70 may thus frictionally engage the outer surface 42 of straw 40 along the length of the straw 40 allowing the straw to be telescopically positioned relative to straw 50.

For instance, with reference again to FIGS. 6, 7 and 8, the attachment member of at least one embodiment may include ledge or step 76 disposed on an internal surface thereof and separating the smaller diameter of open end 74 from the larger diameter of open end 72. In this manner, open end 72 is placed over end 51 of one straw 50 wherein the ledge or step 76 abuts against the edge of end 51 preventing the attachment member 70 from sliding any further along the length of the straw 50. A second, smaller straw 40 is then disposed through open end 74. The smaller diameter of open end 74 frictionally engages the outer surface of straw 40 allowing the straw 40 to be selectively positioned in a telescopic manner relative to straw 50, as indicated by Arrow A in FIG. 11. The frictional engagement will allow the straw to remain in a desired telescopic position until the user re-positions the straw 40.

This allows two or more of the plurality of straws 30, 40, 50 to be telescopically arranged with one another, for example, in order to extend the reach or length of the straws. This can be advantageous for beverage containers that have a depth larger than the length L1, L2, L3 of any one of the straws 30, 40, 50.

FIGS. 12 through 15 illustrate yet another embodiment of the present invention. In particular, the housing 120, and in particular the housing body 112 and cap 114 include cooperative threaded components 118, 113. In this manner, the cap 114 is removably attachable to the body 112 via the cooperative threaded components 118, 113 by twisting the cap 114 relative to the body 112.

Figure 13:
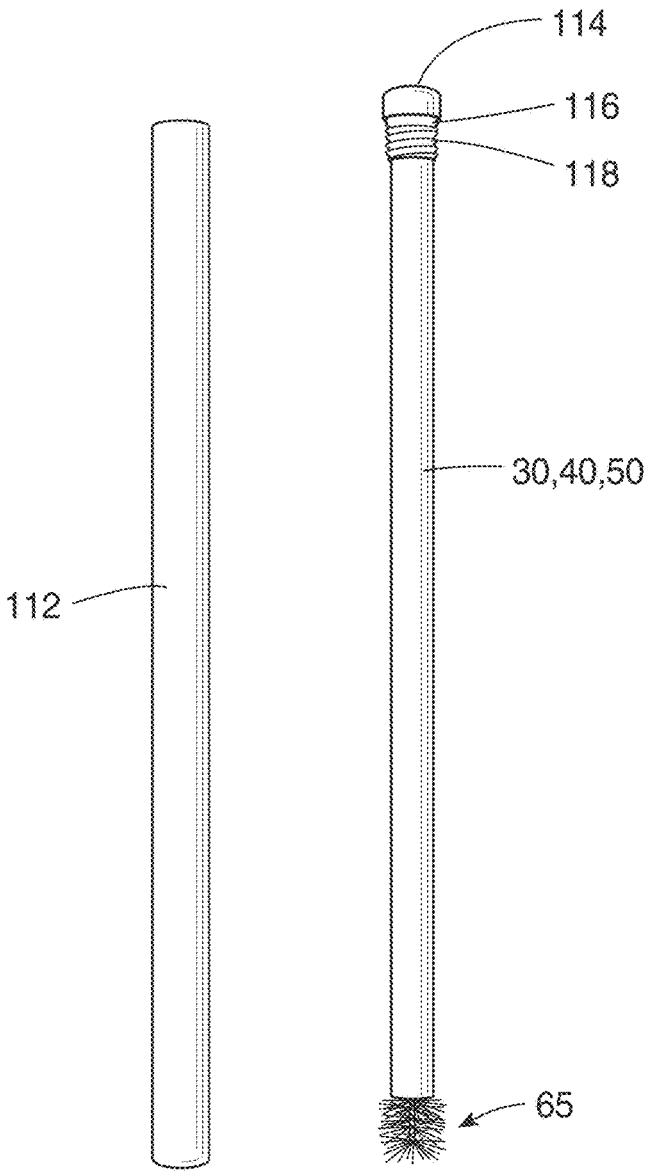
FIG. 13 is a side view illustrating the straw assembly of FIG. 12 with the housing body separated from the end cap, nested straws and brush assembly, wherein the brush head retains the plurality of straws in the nested configuration around the brush stem.
Figure 14:
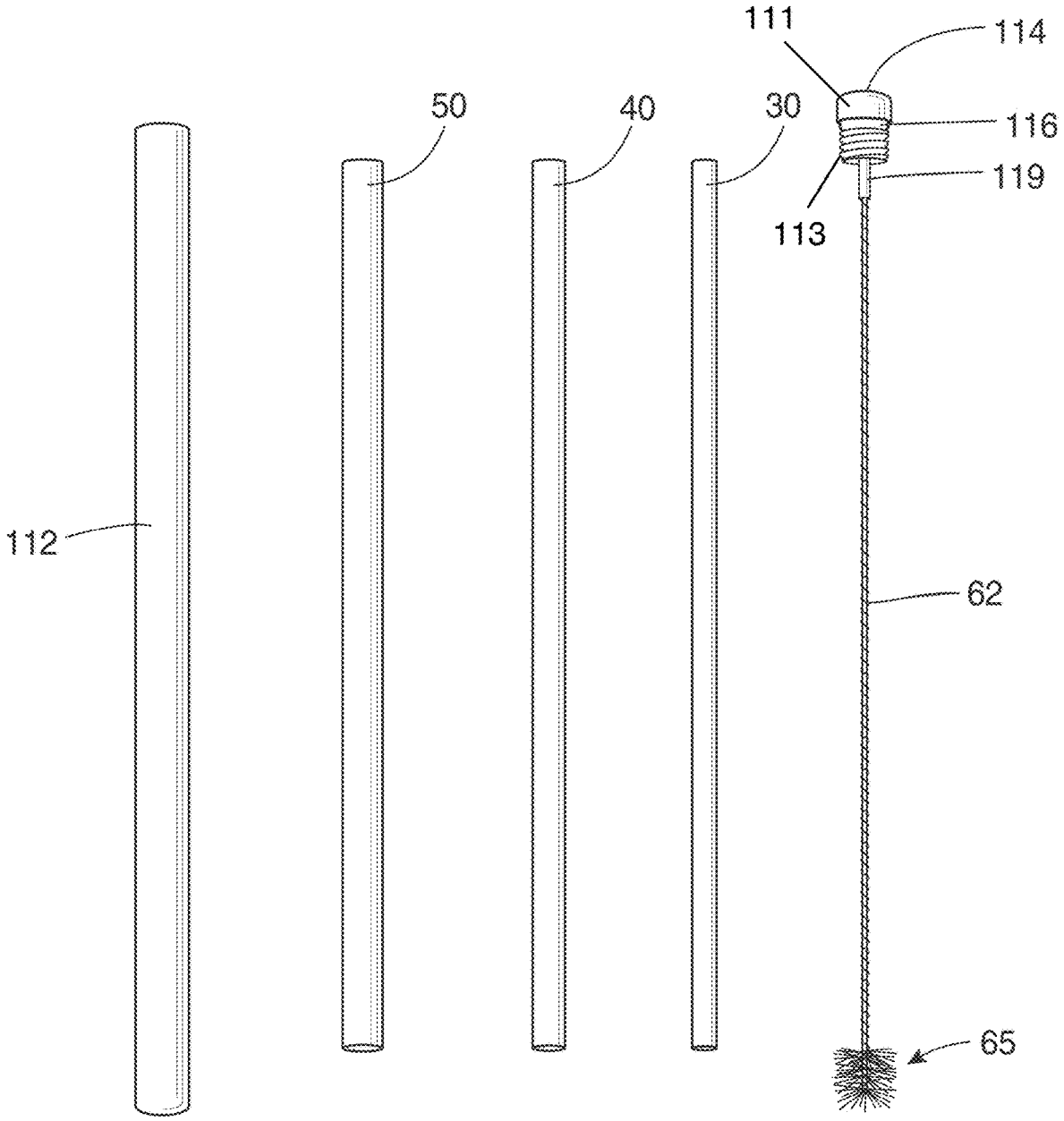
FIG. 14 is an exploded view of the straw assembly illustrated in FIGS. 12 and 13.
Figure 15:
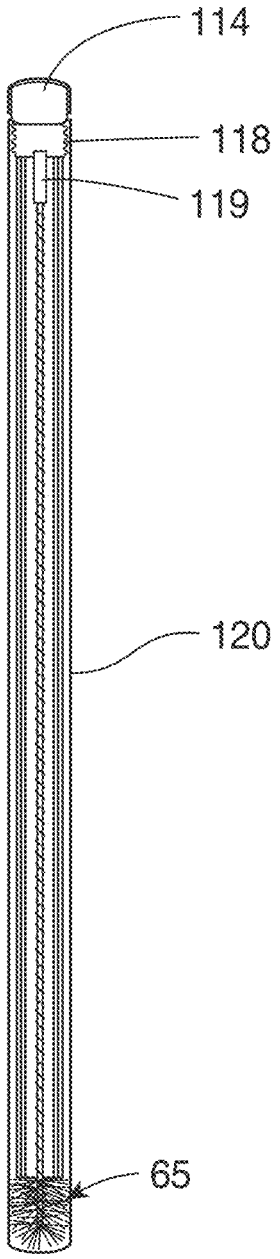
FIG. 15 is a side cut-away view of the straw assembly illustrated in FIGS. 12, 13 and 14.
Figure 16A:
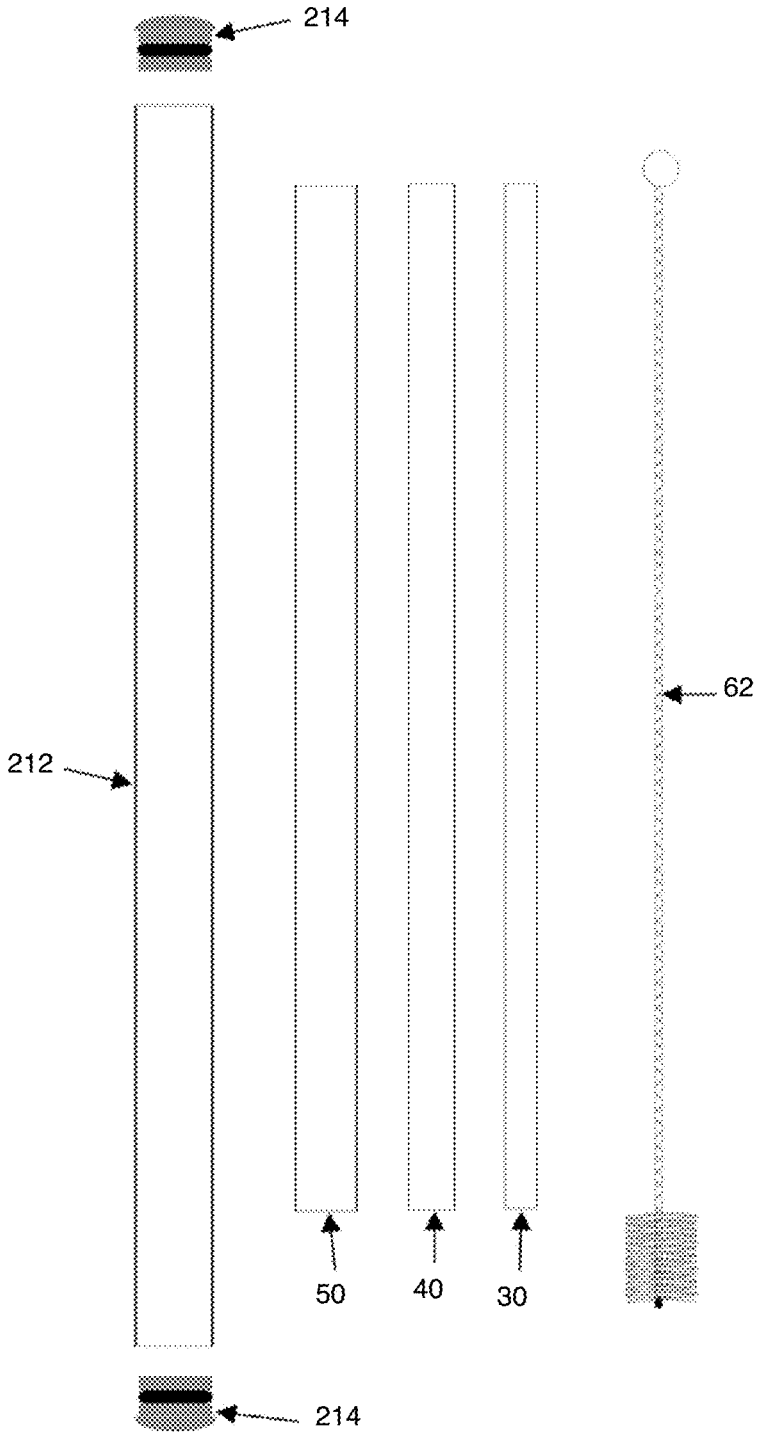
FIG. 16A illustrates a complete and separated straw set as disclosed in accordance with at least one embodiment herein, comprising three nesting straws, a brush assembly, a housing, and two plug style end caps with O-rings.
Figure 16B:
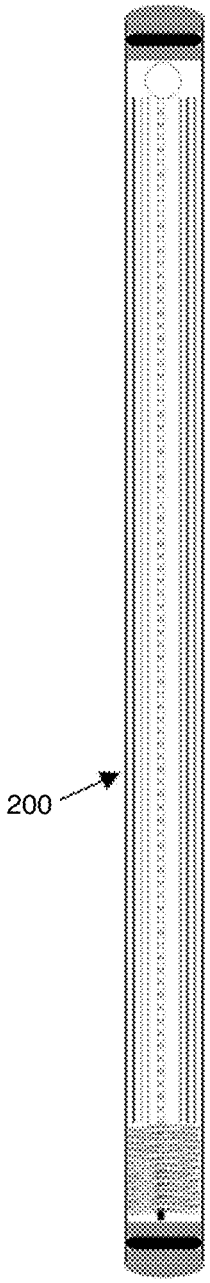
FIG. 16B illustrates a side cut-away view of the straw set of FIG. 16A in assembled form.
Figure 17A:
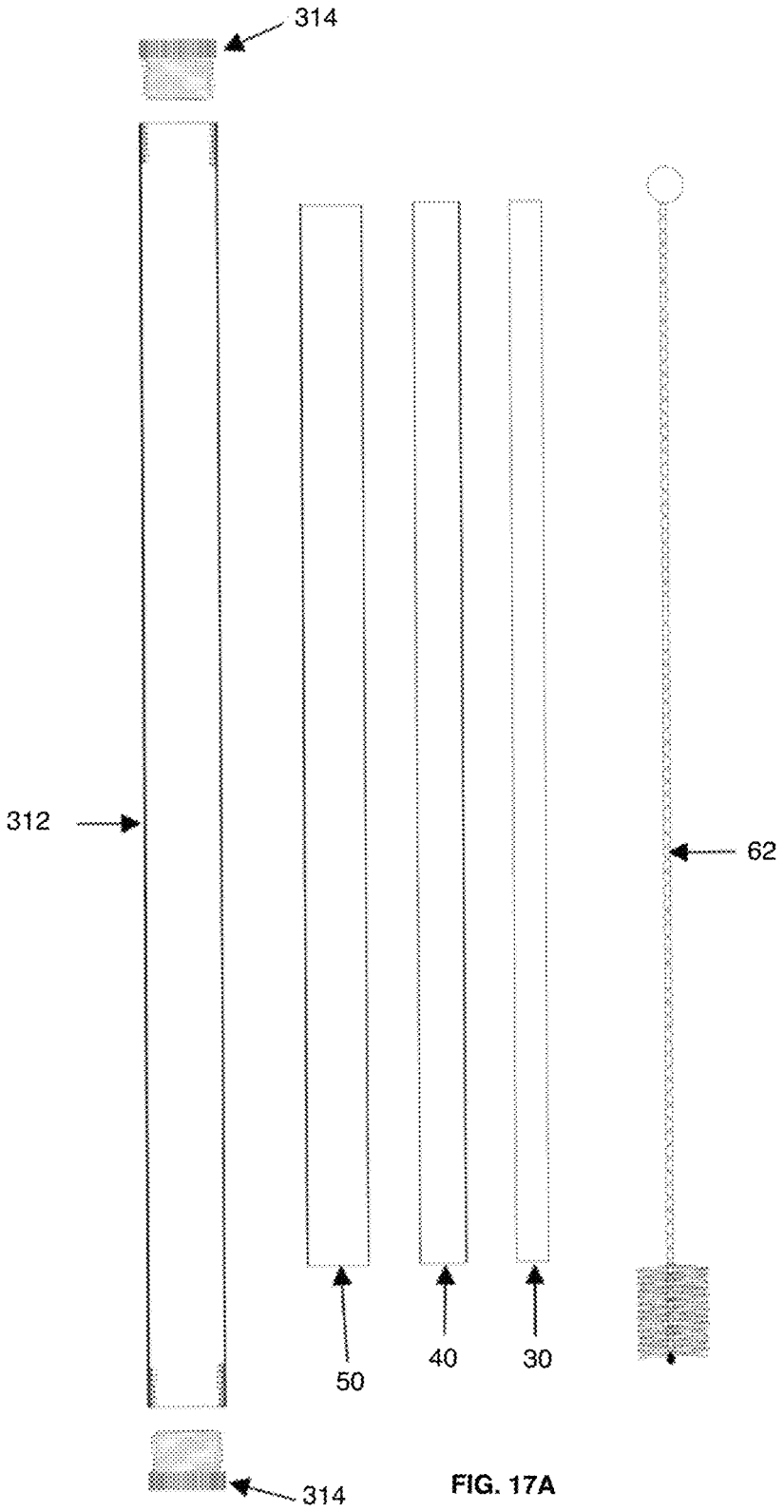
FIG. 17A illustrates a complete and separated straw set as disclosed in accordance with another embodiment herein, comprising three nesting straws, a brush assembly, the case housing, and two-threaded end caps.
Figure 17B:
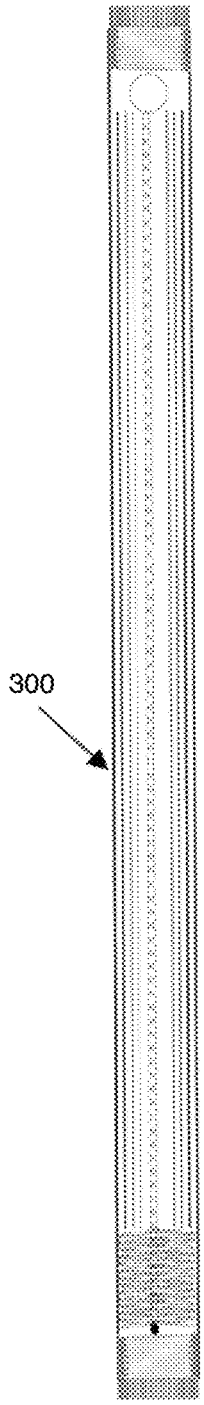
FIG. 17B illustrates a side cut-away view of the straw set of FIG. 17A in assembled form.
Figure 18A:
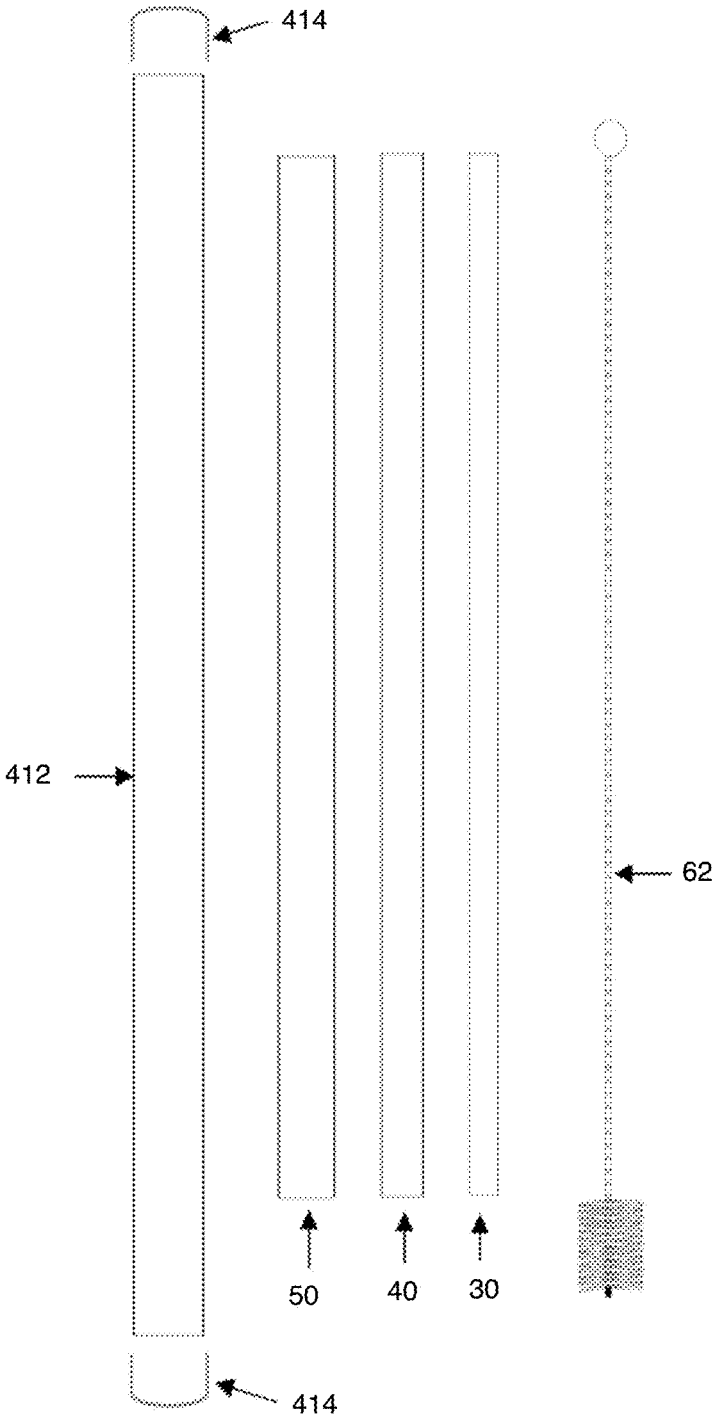
FIG. 18A illustrates a complete and separated straw set as disclosed in accordance with another embodiment herein, comprising three nesting straws, a brush assembly, a housing, and two-sliding end caps.
Figure 18B:
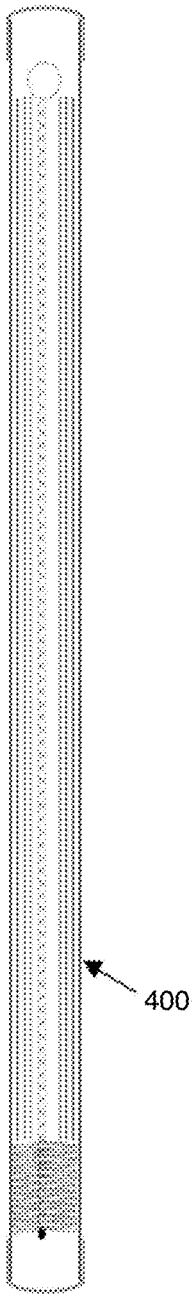
FIG. 18B illustrates a side cut-away view of the straw set of FIG. 18A in assembled form.
Figure 19A:
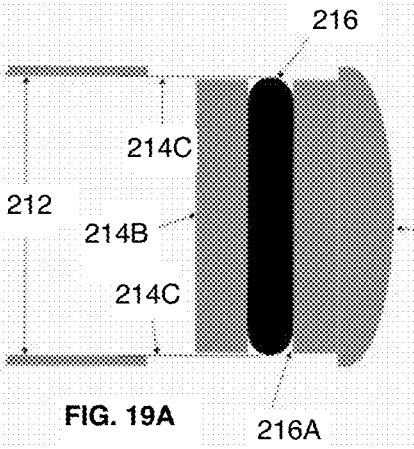
FIGS. 19A, 19B, 19C 19D and 19E are fragmentary perspective and side views showing the plug style end caps with O-rings from FIGS. 16A and 16B.
Figure 19B:
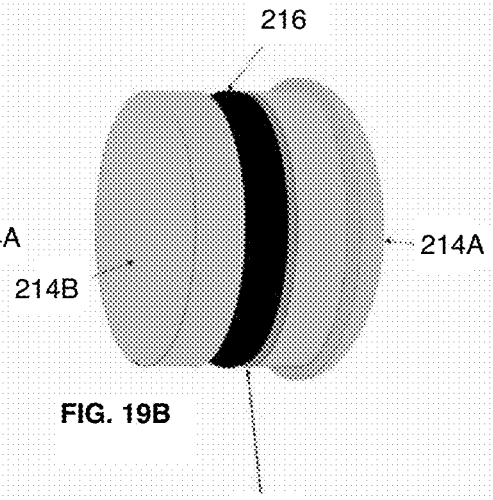
Figure 19C:
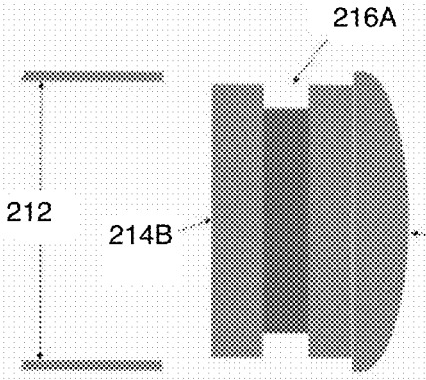
Figure 19D:
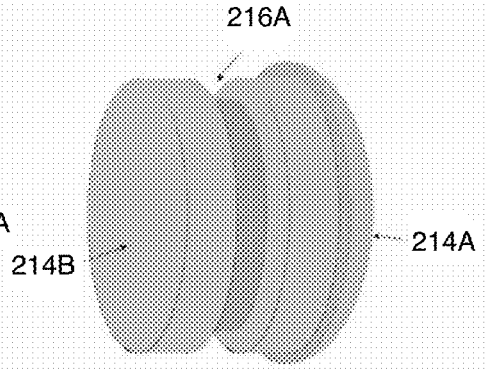
Figure 19E:
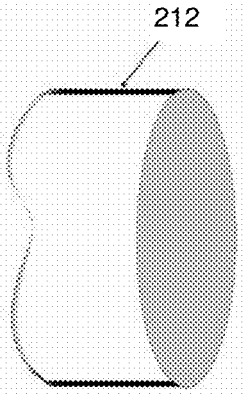
Figures 20A, 20B, 20C, 20D:
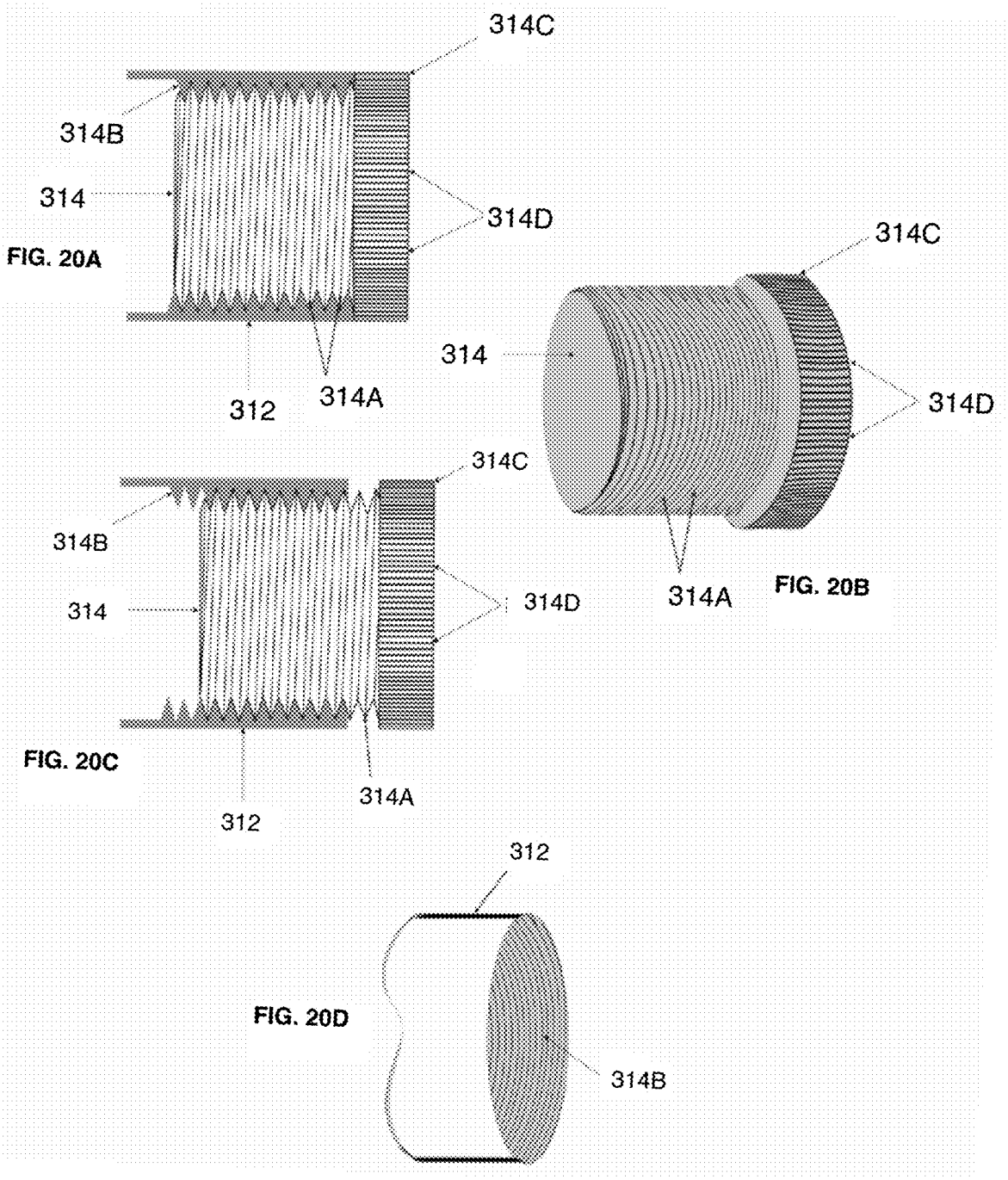
FIGS. 20A, 20B, 20C and 20D are fragmentary perspective and side views showing the threaded end caps from FIGS. 17A and 17B.
Figure 21A:
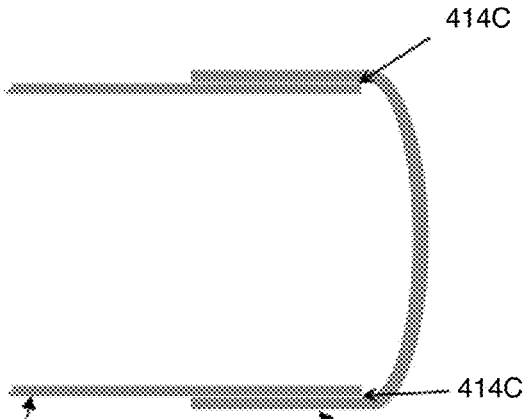
FIGS. 21A, 21B, 21C and 21D are fragmentary perspective and side views showing the sliding end caps from FIGS. 18A and 18B.
Figure 21B:
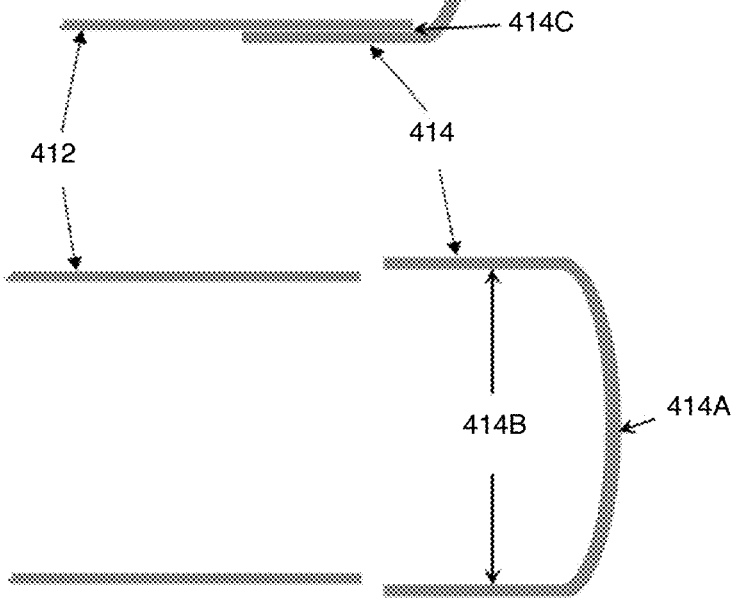
Figure 21C:
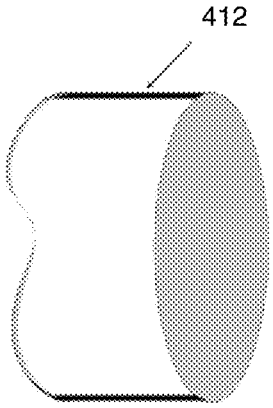
Figure 21D:
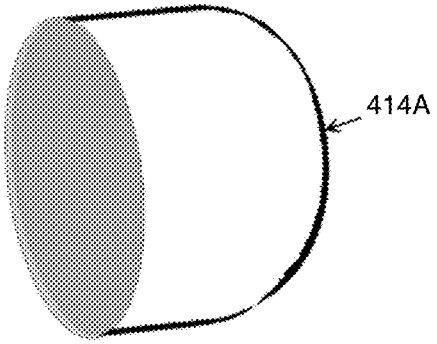
Figure 22:
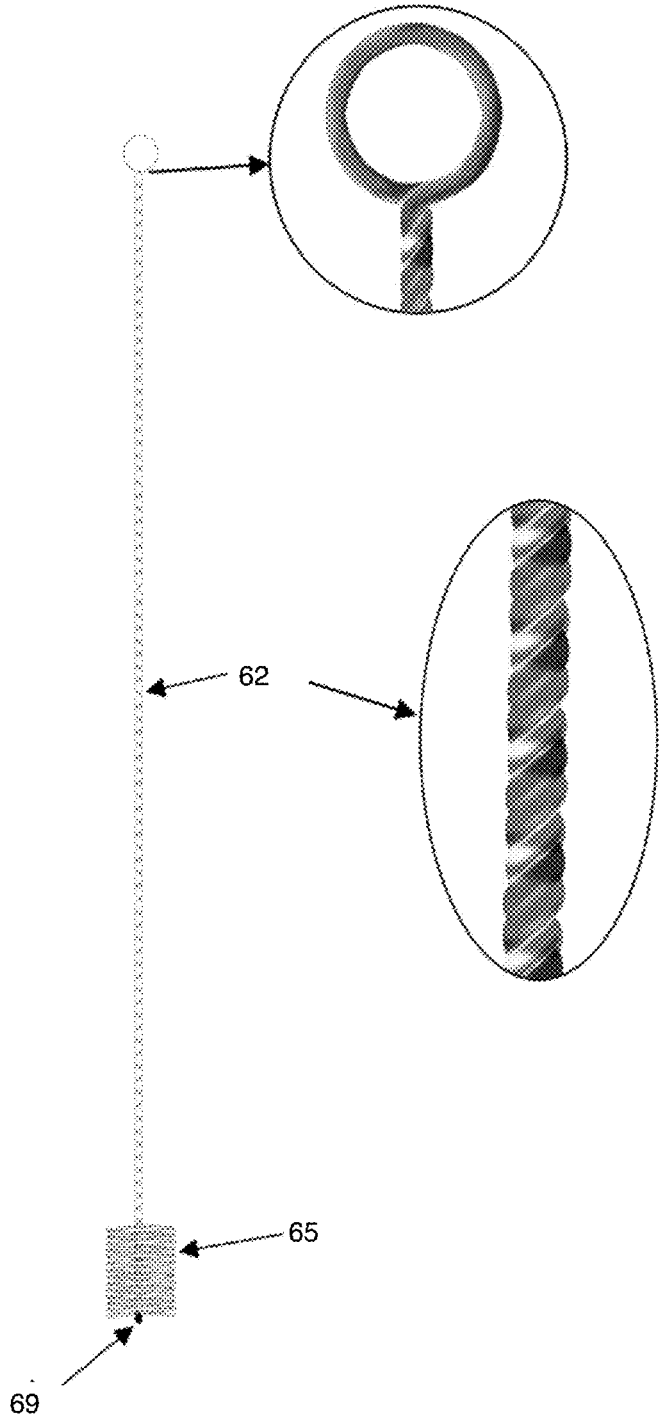
FIG. 22 is an overview of the brush assembly included as a component of the embodiment illustrated in FIGS. 16A through 18B and FIGS. 23A through 31.
Figure 23A:
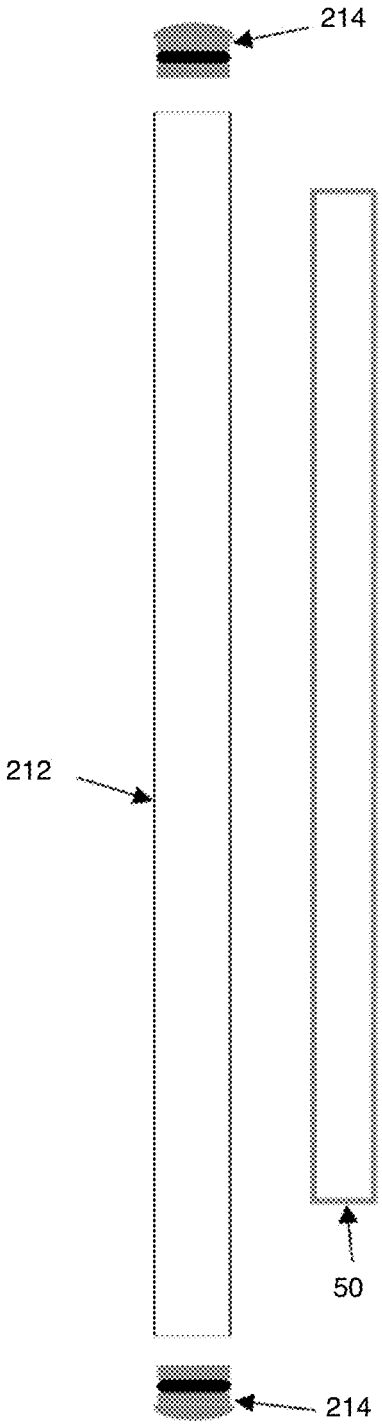
FIG. 23A is a side view of the housing of at least one embodiment, along with a single straw.
Figure 23B:
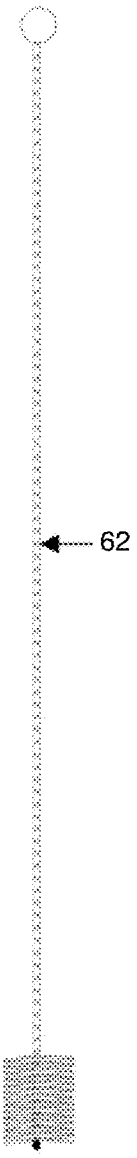
FIG. 23B is a side view of the brush assembly as disclosed in accordance with at least one embodiment herein.
Figure 23C:
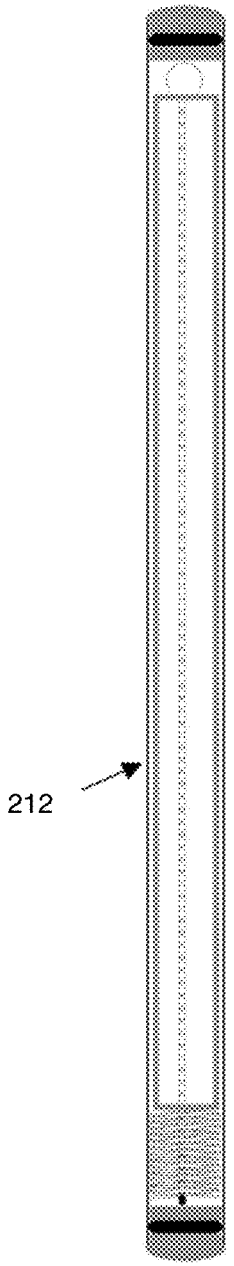
FIG. 23C is a side cut-away view of an assembled set comprising a housing, brush assembly, two end caps, and a single straw.
Figure 24A:
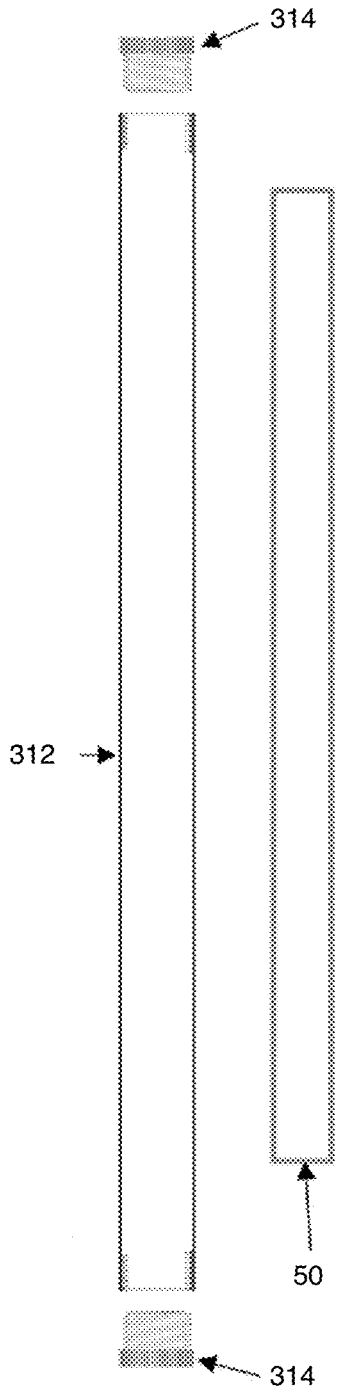
FIG. 24A is a side view of the housing of at least one embodiment, along with a single straw.
Figure 24B:
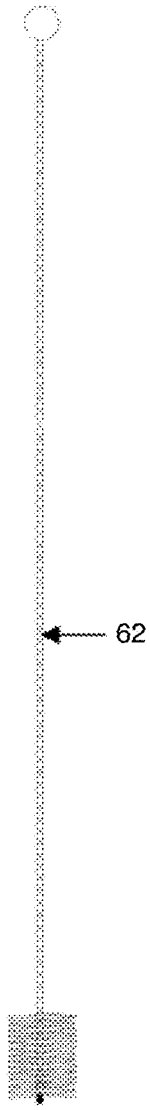
FIG. 24B is a side view of the brush assembly as disclosed in accordance with at least one embodiment herein.
Figure 24C:
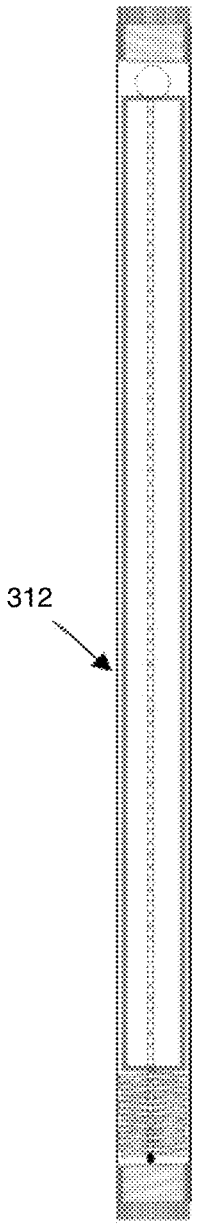
FIG. 24C is a side cut-away view of an assembled set comprising a housing, brush assembly, two end caps, and a single straw.
Figure 25A:
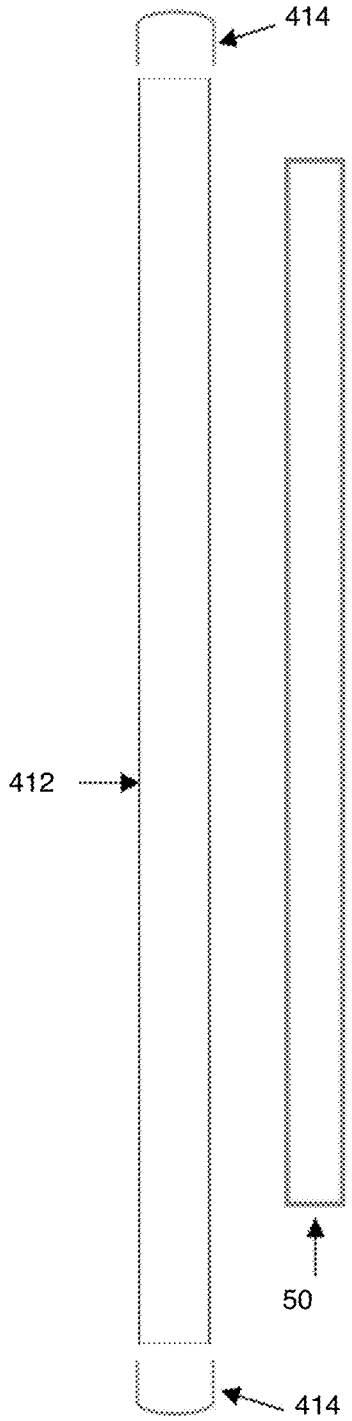
FIG. 25A is a side view of the housing of at least one embodiment, along with a single straw.
Figure 25B:
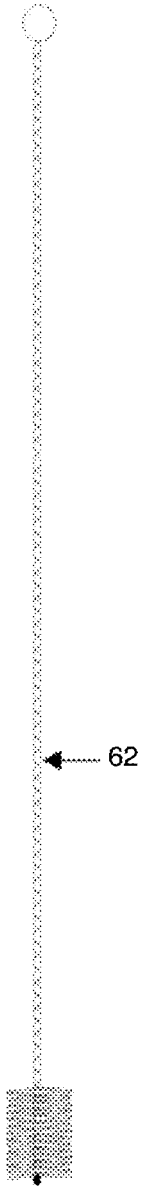
FIG. 25B is a side view of the brush assembly as disclosed in accordance with at least one embodiment herein.
Figure 25C:
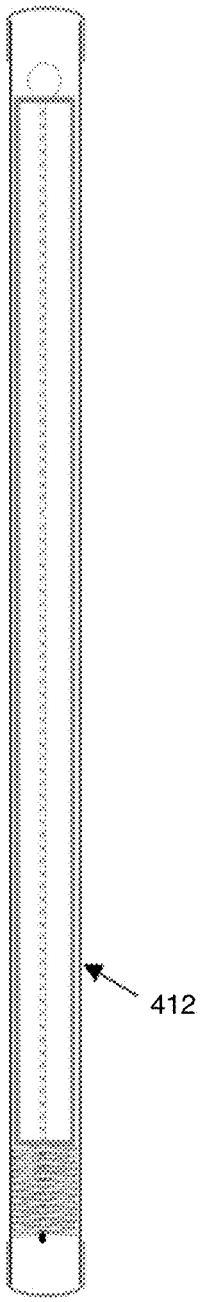
FIG. 25C is a side cut-away view of an assembled set comprising a housing, brush assembly, two end caps, and a single straw.

Moreover, with reference to FIGS. 13 and 14, the cap 114 of at least one embodiment may include a rubber or other like gasket 116 or O-ring disposed around a neck portion, below an enlarged head and above the threaded components 118. When the cap 114 is secured to the body 112, gasket 116 or O-ring may be disposed between the head 111 of the cap 114 and a top edge of the body 112. This can help secure the cap 114 to the body 112 and create an air tight or substantially air tight enclosure therein.

Similar to the embodiment illustrated in FIGS. 1 through 5, the brush stem 62 is fixed to the cap 114 and extends downward therefrom and is axially disposed relative to the straws 30, 40, 50 in a similar manner as described above. In some embodiments, a collar 119 may extend from the cap 114 in a surrounding relation to a portion of the brush stem 62. The collar 119 is structured to provide additional stability to the brush stem 62 and restrict excessive bending or flexing thereof, particularly at or near the cap 114.

FIGS. 16A through 34 represent additional alternative embodiments of the various reusable straw assemblies of the present invention.

For instance, referring now to FIGS. 16A-18B and 23-25, the straw assembly of at least one embodiment may have closures or end caps on one or both ends of the housing body 212, 313, 412 allowing for an air tight seal of the straw housing. Many different options for an end cap or closure are possible.

As an example, FIGS. 16A, 16B and 23A, 23B and 23C illustrate an exemplary "plug style" end cap 214, which can be seen in FIGS. 19A, 19B, 19C and 19D. For example, the housing 200, such as the end cap 214 and/or housing body 212 of at least one embodiment is constructed of a food grade material such as stainless steel or plastic and rubber. The end cap 214 fits inside the straw housing 212 sliding until it is stopped by the end cap's head 214A. The narrower end 214B of end cap 214 is only slightly smaller in diameter 214C than the inside diameter of the straw housing 212. This allows for a snug fit, but not an airtight fit. An O-ring 216 is seated in a channel 216A cut into the end cap's material near the center. The head 214A of the end cap 214 has the same diameter as the outside diameter of the straw housing 212. This head 214A stops plug 214 from completely entering the straw housing 212.

Furthermore, FIGS. 17A, 17B and 24A, 24B, and 24C illustrate a "threaded style" end cap 314, which can also be seen in FIGS. 20A, 20B, 20C and 20D. For example, the housing 300, such as the the end cap 314 and/or housing body 312 is constructed of a food grade material such as stainless steel or plastic. End cap 314 has a helical ridge or "male threading" 314A which corresponds to a helical ridge or "female threading" 314B on the inside diameter of each end of the straw housing 312. End cap 314 fits inside the straw housing 312 by joining the male threading 314A of the cap 314 with the female threading 314B of the straw housing 312. End cap 314 is turned clockwise, or if otherwise designed, counter clockwise until it is stopped by the cap's "head" 314C. The threading 314A and 314B combined with the head 314C produces an air tight seal in the straw housing 312. For ease of use and for added grip, grooves 314D can be added to the sides of the head 314C.

Additionally, FIGS. 18A, 18B and FIGS. 25A, 25B and 25C illustrate a "round sliding cap style" end cap 414, which can be seen in FIGS. 21A, 21B, 21C and 21D. For example, the housing 400, such as the end cap 414 and/or housing body 412, is comprised of a food grade material such as stainless steel or plastic. End cap 414 has a round dome "radius" head 414A with an extended tubular body 414B. The inside diameter of the extended body 414B of the sliding dome cap 414 is slightly larger than the outside diameter of the straw housing 412. This slight increase in diameter allows the round sliding cap to fit over the end of the straw set housing, and slide until it is stopped by the dome head 414. The snug fit of the sliding end cap 414 over the housing body 412 combined with the end of the housing body 412 making contact 414C with the dome head creates an airtight seal.

Alternate methods of connecting the variety of plugs 214, 314, 414 to the brush assembly 60 can be seen in FIGS. 26-31.

Figure 26:
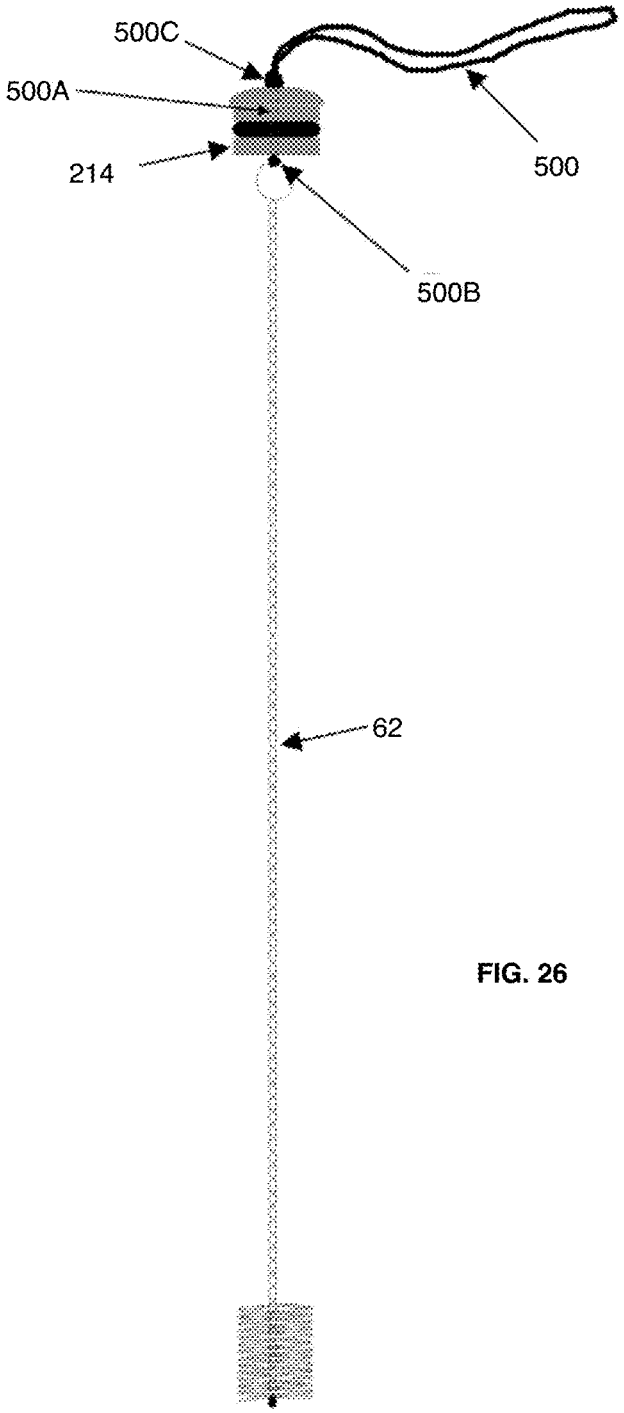
FIG. 26 is a side view of a brush assembly as disclosed in accordance with at least one embodiment herein, comprising a brush stem connected to a plug style end cap with O-ring by a flexible cord.

In FIG. 26 end plug 214 is connected to the brush assembly 60 or brush stem 62 with a cord 500 which passes through a hole 500A drilled in end plug 214. A knot 500B is tied around the loop end of the brush stem 62, holding the loop end close to the cap. Another knot 500C is tied in the cord 500 on the outside of the head of the cap. This knot 500C holds the brush stem 62 and end cap 214 together.

Figure 27:
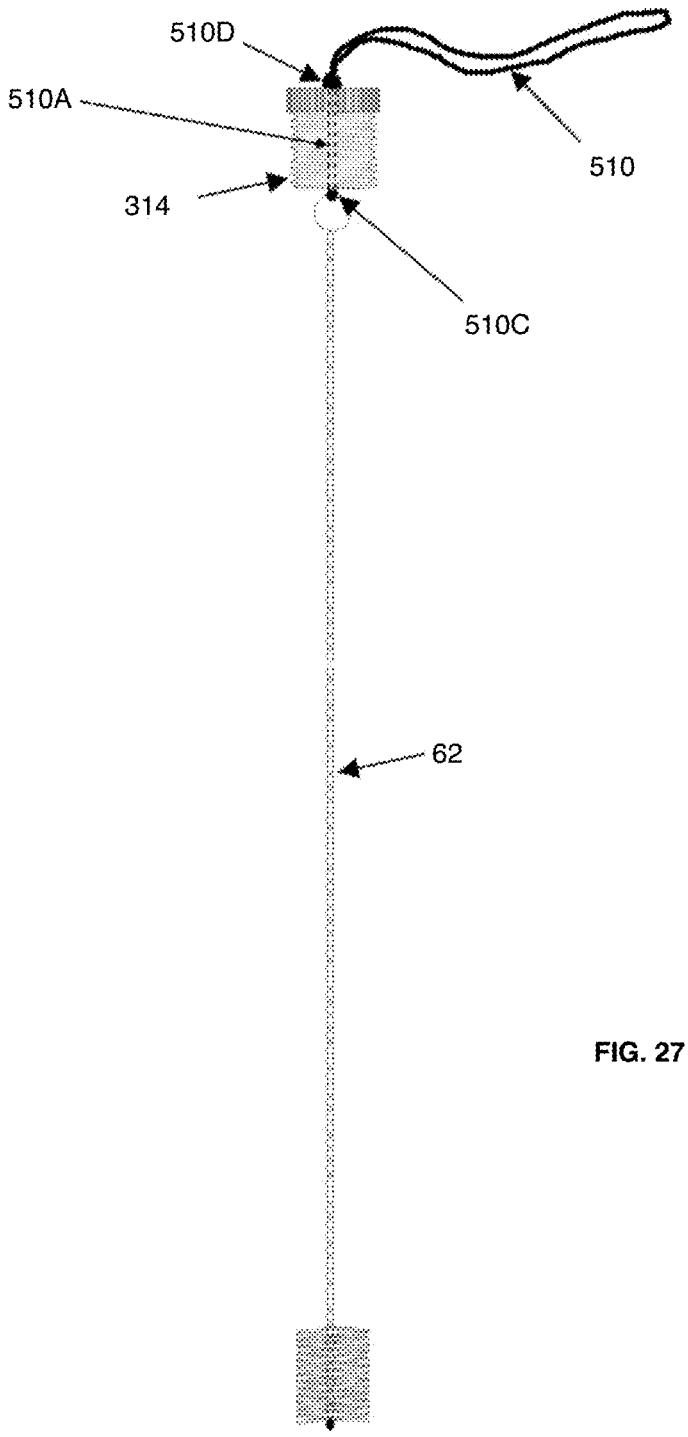
FIG. 27 is a side view of another brush assembly as disclosed in accordance with at least one embodiment herein, comprising a brush stem connected to a threaded end cap by a flexible cord.

In FIG. 27, threaded end plug 314 is connected to the brush stem 62 with a cord 510, which passes through a hole 510A drilled through the center of end plug 314. A knot 510C is tied around the loop end of the brush stem 62, holding the loop end close to the cap. Another knot 510D is tied in the cord 510 on the outside of the head of cap. This knot 510D holds the brush stem and end cap 314 together.

Figure 28:
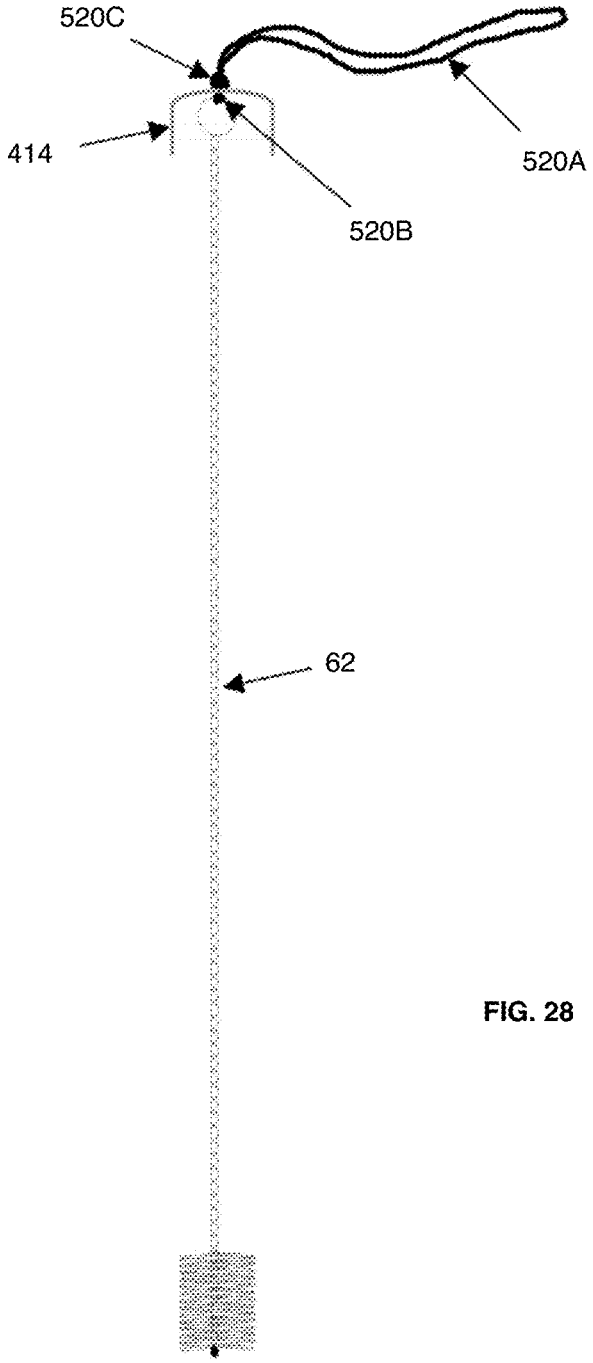
FIG. 28 is a side view of another brush assembly as disclosed in accordance with at least one embodiment herein, comprising a brush stem connected to a sliding style end cap by a flexible cord.

In FIG. 28 sliding end cap 414 is connected to the brush stem 62 with a cord 520A which passes through a hole drilled through the sliding cap. A knot 520B is tied around the loop end of the brush stem 62, holding the loop end close to the cap. Another knot 520C is tied in the cord 520A on the outside of the head of the cap. This knot 520C holds the brush stem 62 and end cap 414 together.

Figure 29:
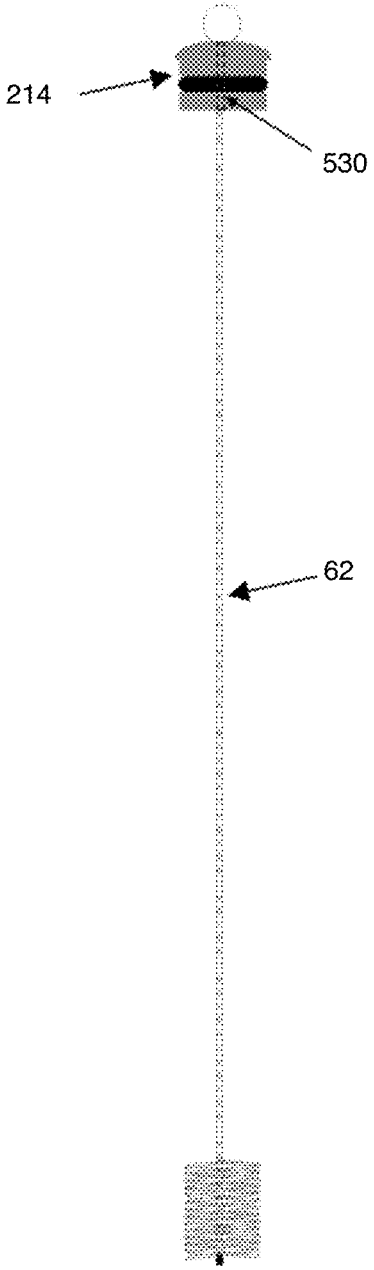
FIG. 29 is a side view of another brush assembly as disclosed in accordance with at least one embodiment herein, comprising a brush stem connected to a plug style end cap with O-ring by passing the back or "tail end" of the pipe cleaner through a center hole in the plug style end cap.
Figure 30:
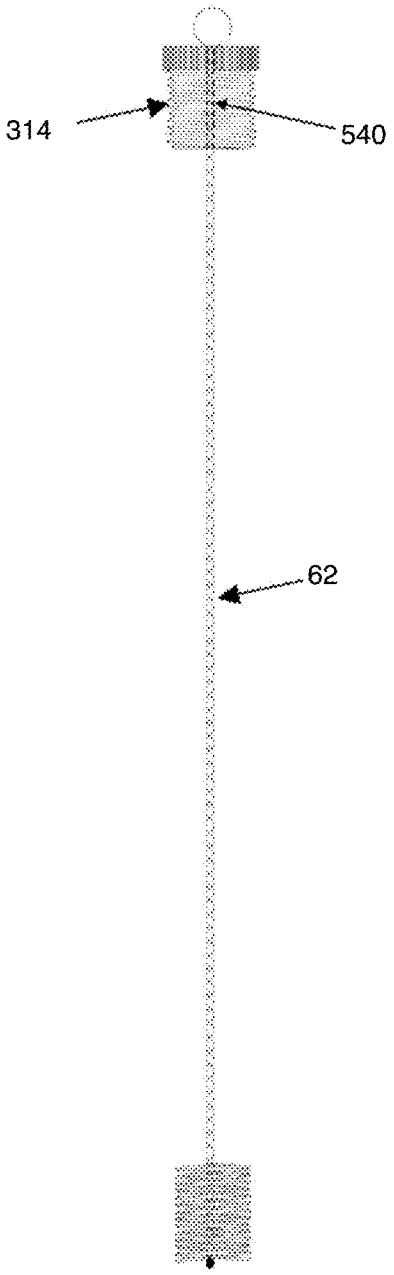
FIG. 30 is a side view of another brush assembly as disclosed in accordance with at least one embodiment herein, comprising a brush stem connected to a threaded end cap by passing the back or "tail end" of the pipe cleaner through a center hole in the threaded end cap.

In FIG. 29, brush stem 62 passes through end plug 214 in a hole 530 drilled or disposed through the center of the plug In FIG. 30, brush stem 62 passes through threaded plug 314 in a hole 540 drilled or disposed through the center of the plug.

Figure 31:
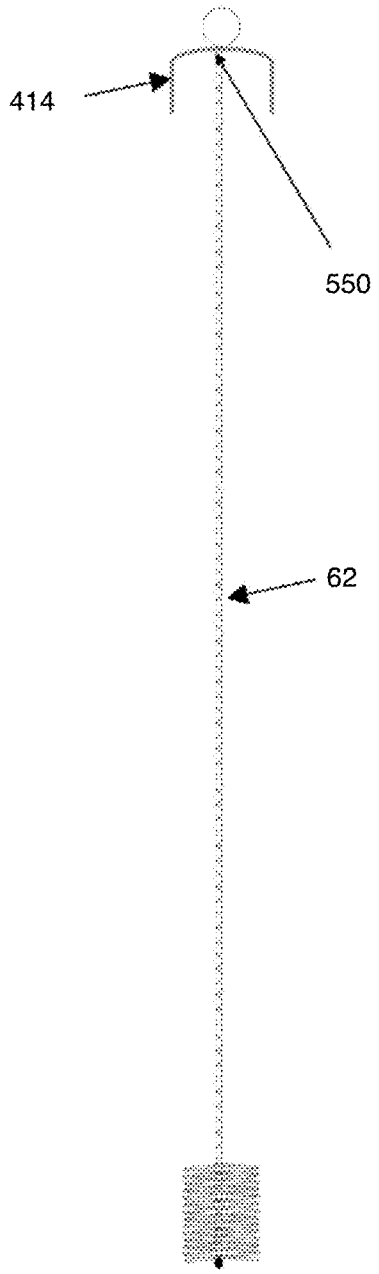
FIG. 31 is a side view of another brush assembly as disclosed in accordance with at least one embodiment herein, comprising a brush stem connected to a sliding end cap by passing the back or "tail end" of the pipe cleaner through a center hole in the sliding end cap.

In FIG. 31, brush stem 62 passes through sliding end cap 414 in a hole 550 drilled through the center of the plug.

Figure 32:
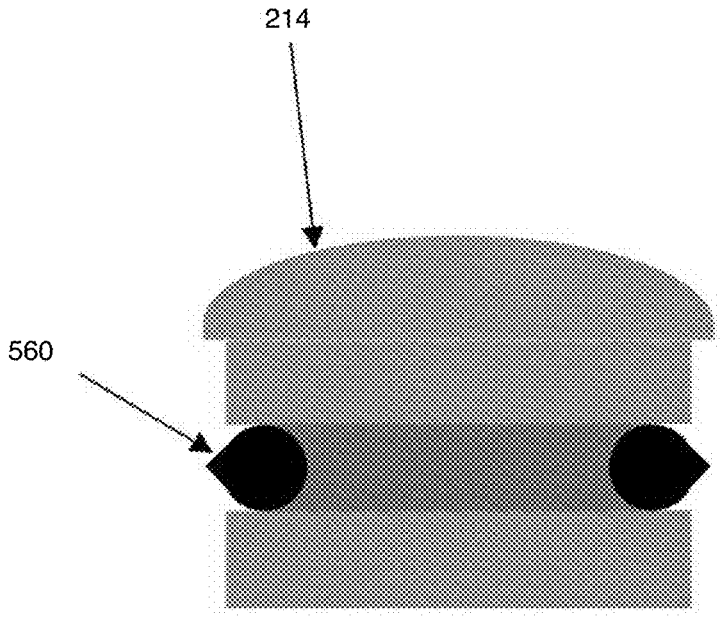
FIG. 32 is a fragmentary perspective view showing the plug style end cap with an optional "winged" O-ring as disclosed in accordance with at least one embodiment of the present invention, which may be used, for example, in the embodiments of FIGS. 1, 16A, 16B, 19A, 19B, 23A, 23C, 26, and 34A-F.
Figure 33:
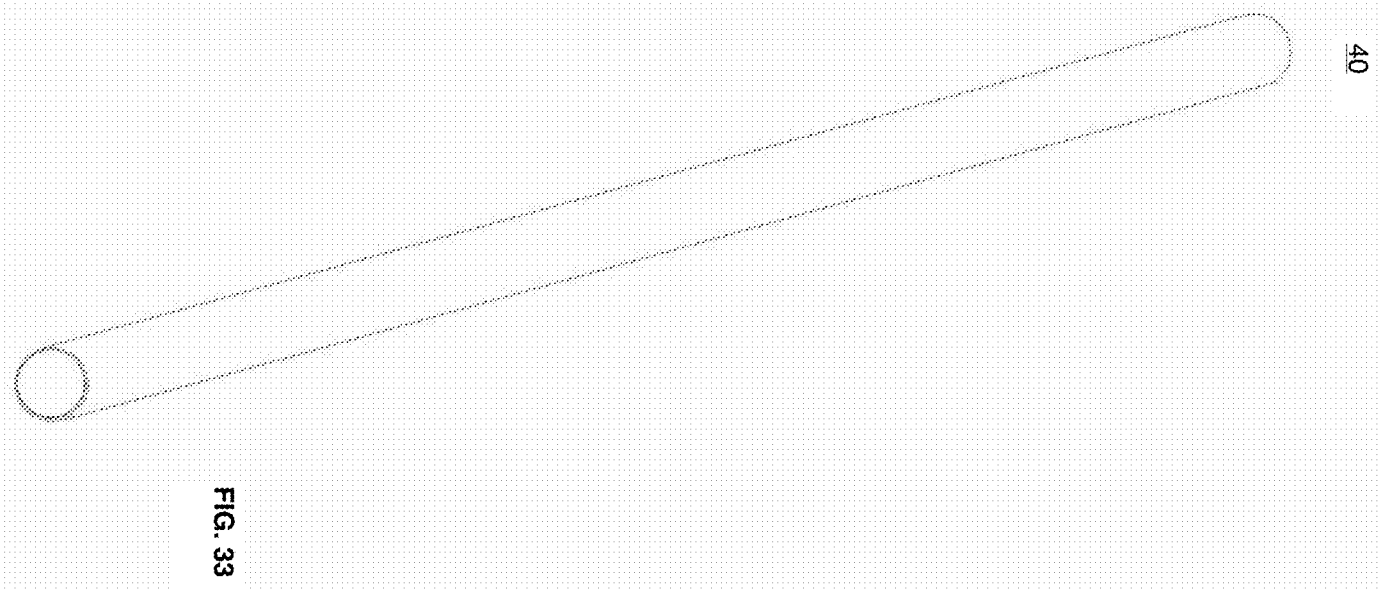
FIG. 33 is a perspective view showing the cylindrical tube shape of the plurality of straws as disclosed in accordance with at least one embodiment herein.

As seen in FIG. 32, an alternate style of O-ring can be used to create a tighter, more effective airtight seal. In FIG. 32, a winged O-ring 560 can be used on plug style cap 214 creating a more flexible and bendable rubber seal.

Variations and combinations of all these styles of end caps can be mixed and matched to comprise the most effective and useful embodiment of the straw set. FIGS. 34A-F show one such variation, where one end of the case is permanently sealed and the other seals with one of the chosen plug styles.

In this embodiment brush assembly 60 is connected to an end plug 614, which is a which includes a helical "male threading" 634 and an airtight O-ring 635 seal. The connection of the brush assembly 60 to the end plug 614 is made by adhering the tail end of the brush stem to a hole 636 drilled in the center of the end plug. The straw housing 612 has one sealed end 638 and one open end with a helical "female threading" 639. The plug 614 and brush assembly 60 is joined to the straw housing 612 by matching the threads and turning clockwise or counter clockwise depending on design.

Figures 34A, 34B, 34C, 34D, 34E, 34F:
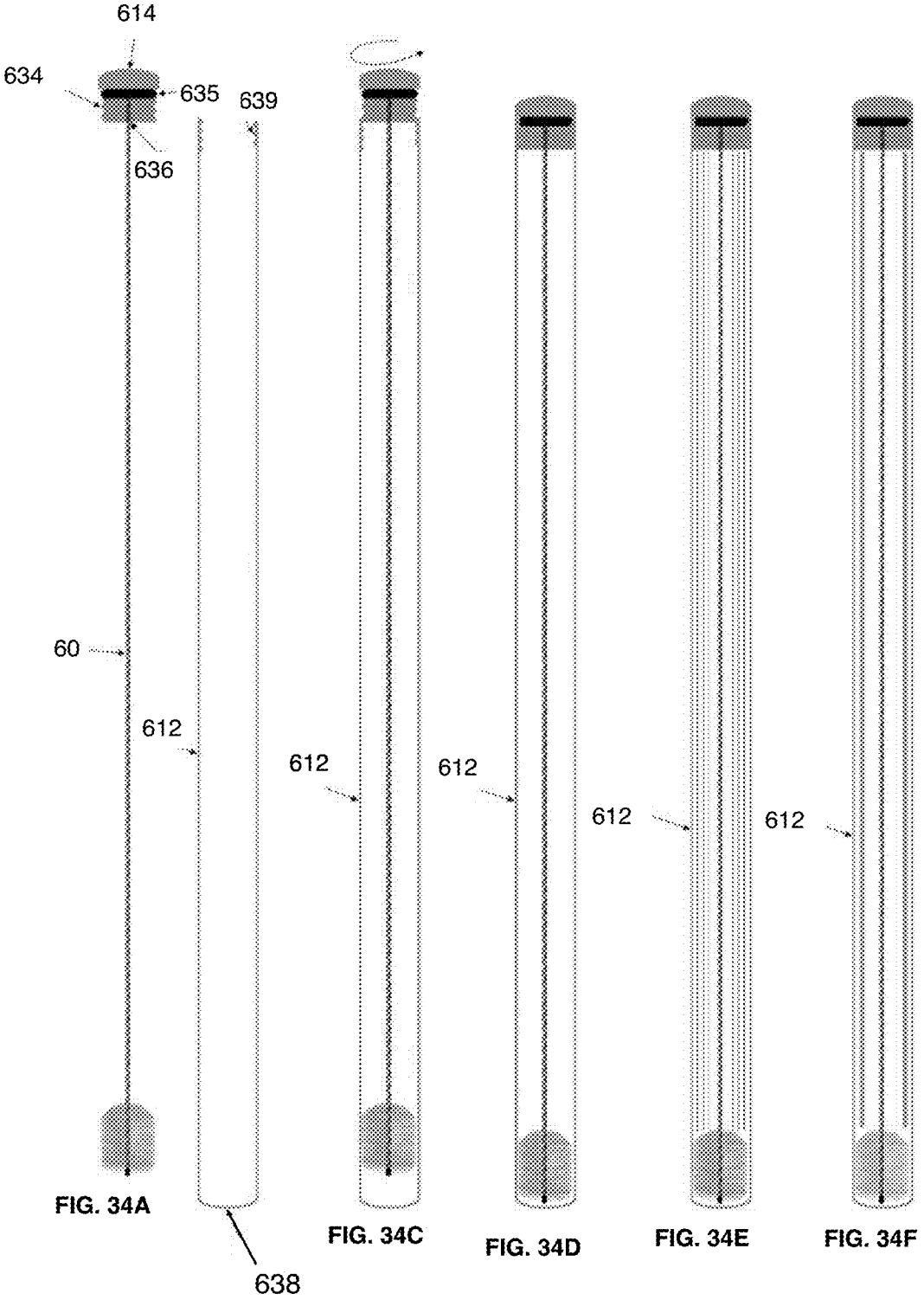
FIGS. 34A, 34B, 34C, 34D, 34E and 34F are side views of a straw set option, one in which the straw set housing has one permanently sealed end and is closed on the other end by a threaded end cap with O-ring with the straw cleaning apparatus permanently affixed to the cap through a hole drilled through its center.

Once threaded until the head of end plug meets the walls of straw set housing, an airtight seal is formed as seen FIG. 34D.

This embodiment also includes a set of nesting straws, as shown in FIG. 34E, or a single straw, as shown in FIG. 34F.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A reusable straw assembly, comprising:

a housing comprising a housing body and an end cap, said end cap being removably connected to said housing body, at least one reusable straw, each reusable straw comprising a tubular configuration with a first end, a second end, a length and a longitudinally open interior with a diameter, said at least one reusable straw being disposable within said housing with said end cap connected to said housing body, a brush assembly comprising a brush stem and a brush head, said brush stem being fixed to said end cap, and said brush head being disposed on a distal end of said brush stem, and wherein said brush stem is disposable within said at least one reusable straw with said brush head extending longitudinally and laterally beyond said second end of said at least one reusable straw.

2. The reusable straw assembly as recited in claim 1 wherein said at least one reusable straw is retained on said brush stem by said brush head.

3. The reusable straw assembly as recited in claim 2 wherein said brush head comprises a rigidity structured to prevent said at least one reusable straw from sliding off of said brush stem absent application of a manual sliding force exerted thereon.

4. The reusable straw assembly as recited in claim 1 wherein said brush head comprises a width greater than said diameter of said at least one reusable straw.

5. The reusable straw assembly as recited in claim 4 wherein said brush head at least partially contacts an interior wall of said housing body when said end cap is connected to said housing body.

6. The reusable straw assembly as recited in claim 4 wherein said brush head at least partially contacts an interior wall of said housing body when said end cap is connected to said housing body.

7. The reusable straw assembly as recited in claim 1 further comprising a plurality of reusable straws, each of said plurality of reusable straws comprising a tubular configuration with a first end, a second end, a length and a longitudinally open interior with a diameter, said diameter of each of said plurality of reusable straws being different from one another.

8. The reusable straw assembly as recited in claim 7 wherein each of said plurality of reusable straws being disposable in a nested configuration within said housing while said brush stem is axially disposed therewith.

9. The reusable straw assembly as recited in claim 8 wherein said plurality of reusable straws are retained on said brush stem between said end cap and said brush head.

10. The reusable straw assembly as recited in claim 9 wherein said brush head comprises a rigidity structured to restrict said plurality of reusable straws from sliding off of said brush stem absent application of a manual sliding force exerted thereon.

11. The reusable straw assembly as recited in claim 9 wherein said brush head comprises a width greater than said diameter of each of said plurality of reusable straws.

12. The reusable straw assembly as recited in claim 11 wherein said brush assembly comprises a length greater than said length of each of said plurality of reusable straws, wherein said brush head extends longitudinally and laterally beyond said plurality of reusable straws when said plurality of reusable straws are disposed in said nested configuration with said brush assembly axially disposed therewith.

13. The reusable straw assembly as recited in claim 12 wherein said lengths of said plurality of reusable straws are equal.

14. The reusable straw assembly as recited in claim 1 wherein said housing body comprises a neck upon which said end cap is removably disposed.

15. A reusable straw assembly, comprising:

a housing comprising a housing body and an end cap, said end cap being removably connected to said housing body, a plurality of reusable straws comprising at least a first straw and a second straw, said first straw comprising a first end, a second end, a length and a longitudinally open interior with a diameter, said second straw comprising a first end, a second end, a length and a longitudinally open interior with a diameter, said diameter of said first straw being smaller than said diameter of said second straw, wherein said first straw is coaxially disposed within said second straw in a nested configuration, a brush assembly comprising a brush stem and a brush head, said brush stem being fixed to said end cap, and said brush head being disposed on a distal end of said brush stem, and wherein said brush stem is axially disposable within said plurality of reusable straws with said brush head extending longitudinally and laterally beyond said second end of said first straw and said second end of said second straw.

16. The reusable straw assembly as recited in claim 15 wherein said brush head is structured to restrict said plurality of reusable straws from sliding off of said brush stem absent application of a manual sliding force exerted thereon.

17. The reusable straw assembly as recited in claim 15 further comprising an attachment member, said attachment member comprising a first open end and a second open end defining an interior channel there between, wherein said first open end comprises a diameter smaller than a diameter of said second open end.

18. The reusable straw assembly as recited in claim 17 wherein said second open end of said attachment member is disposable around said second straw, and wherein said first straw is disposable through said first open end of said attachment member, said first straw being telescopically disposable relative to said second straw.

19. The reusable straw assembly as recited in claim 18 wherein said attachment member comprises an internal ledge, said first end of said second straw being disposed against said internal ledge while said first straw is telescopically disposable with said second straw.

* * * * *